US006499308B2

(12) United States Patent
Inoue et al.

(10) Patent No.: US 6,499,308 B2
(45) Date of Patent: Dec. 31, 2002

(54) APPARATUS FOR CONTROLLING REFRIGERATION CYCLE AND A METHOD OF CONTROLLING THE SAME

(75) Inventors: Seiji Inoue; Keiji Nonami; Moriya Miyamoto, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/312,700

(22) Filed: May 17, 1999

(65) Prior Publication Data

US 2002/0026803 A1 Mar. 7, 2002

(30) Foreign Application Priority Data

May 19, 1998 (JP) ..... 10-136639
Feb. 19, 1999 (JP) ..... 11-040955

(51) Int. Cl.[7] ..... F25B 29/00
(52) U.S. Cl. ..... 62/228.3; 62/228.4
(58) Field of Search ..... 62/180, 179, 228.1, 62/228.3, 228.4, 228.5, 225

(56) References Cited

U.S. PATENT DOCUMENTS 4,856,286 A * 8/1989 Sulfstede et al. ..... 62/228.4 X
5,142,879 A 9/1992 Nakamura et al. ..... 62/160
5,537,831 A * 7/1996 Isaji et al. ..... 62/228.3 X

FOREIGN PATENT DOCUMENTS

JP 7-158937 6/1995
JP 9-105559 4/1997
JP 10-68554 3/1998

* cited by examiner

*Primary Examiner*—Harry B. Tanner
(74) *Attorney, Agent, or Firm*—Burns, Doane, Swecker & Mathis, LLP

(57) ABSTRACT

An apparatus for controlling a refrigeration cycle for circulating a refrigerant through a compressor 2, a heat exchanger for condensation 4, a flow rate control valve 5, and a heat exchanger for evaporation 6, connected each other, comprising: a first operation means for changing a heat exchanging capability of said heat exchanger for condensation 4, a second operation means for changing a heat exchanging capability of said heat exchanger for evaporation 6, a means for operating a running capacity for changing a running capacity of said compressor, and a control means for reducing a difference between a running condition on a high pressure side or a low pressure side of said refrigeration cycle and a target, wherein when a difference between a running condition on a high or low pressure side and its target is reduced, the control means 15 bring the running condition closer to the target, minimizes a consumption energy, and bring a temperature difference of a heat exchanging fluid between an inlet and an outlet of the heat exchanger for condensation 6 closer to a target temperature difference.

32 Claims, 13 Drawing Sheets

FIG. 6

| No. | ΔF | ΔBK | ΔAK |
|---|---|---|---|
| 1 | −\|ΔFmax\| | −\|BKmax1\| | −\|AKmax1\| |
| 2 | −\|ΔFmax\| | −\|BKmax1\| | 0 |
| 3 | −\|ΔFmax\| | −\|BKmax1\| | +\|AKmax1\| |
| 4 | −\|ΔFmax\| | 0 | −\|AKmax1\| |
| 5 | −\|ΔFmax\| | 0 | 0 |
| 6 | −\|ΔFmax\| | 0 | +\|AKmax1\| |
| 7 | −\|ΔFmax\| | +\|BKmax1\| | −\|AKmax1\| |
| 8 | −\|ΔFmax\| | +\|BKmax1\| | 0 |
| 9 | −\|ΔFmax\| | +\|BKmax1\| | +\|AKmax1\| |
| 10 | −\|ΔFmax\|·0.5 | −\|BKmax2\| | −\|AKmax2\| |
| 11 | −\|ΔFmax\|·0.5 | −\|BKmax2\| | 0 |
| 12 | −\|ΔFmax\|·0.5 | −\|BKmax2\| | +\|AKmax2\| |
| ... | ... | ... | ... |
| 63 | +\|ΔFmax\| | +\|BKmax7\| | +\|AKmax7\| |

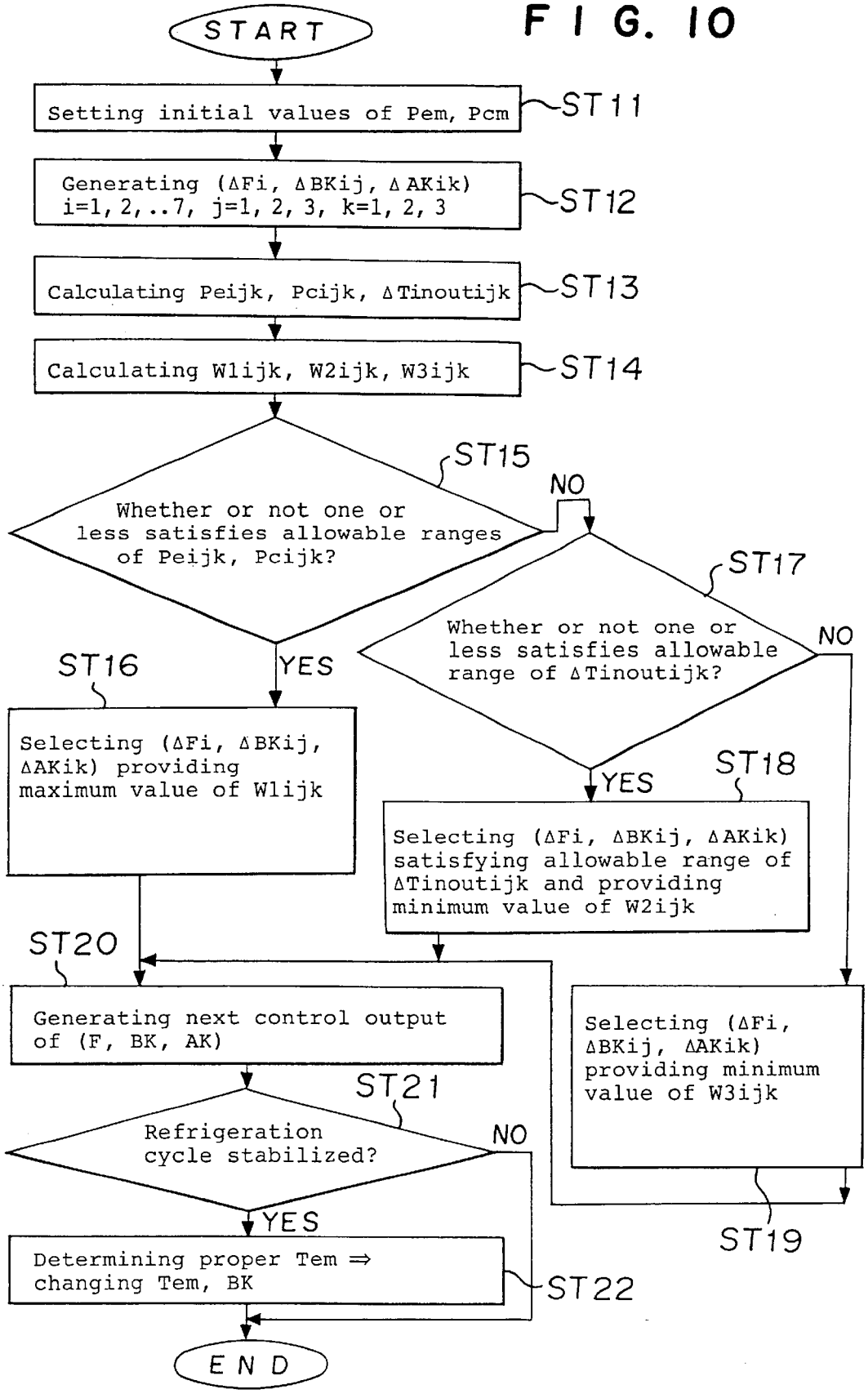
FIG. 10
START
Setting initial values of Pem, Pcm
ST11
Generating (ΔFi, ΔBKij, ΔAKik) i=1, 2, ..7, j=1, 2, 3, k=1, 2, 3
ST12
Calculating Peijk, Pcijk, ΔTinoutijk
ST13
Calculating W1ijk, W2ijk, W3ijk
ST14
ST15
Whether or not one or less satisfies allowable ranges of Peijk, Pcijk?
NO
ST17
Whether or not one or less satisfies allowable range of ΔTinoutijk?
NO
YES
ST16
Selecting (ΔFi, ΔBKij, ΔAKik) providing maximum value of W1ijk
YES
ST18
Selecting (ΔFi, ΔBKij, ΔAKik) satisfying allowable range of ΔTinoutijk and providing minimum value of W2ijk
ST20
Generating next control output of (F, BK, AK)
Selecting (ΔFi, ΔBKij, ΔAKik) providing minimum value of W3ijk
ST19
ST21
Refrigeration cycle stabilized?
NO
YES
Determining proper Tem ⇒ changing Tem, BK
ST22
END

APPARATUS FOR CONTROLLING REFRIGERATION CYCLE AND A METHOD OF CONTROLLING THE SAME

BACKGROUND OF THE INVENTION

1. Field of the Invention

The present invention relates to an apparatus for controlling a compressor, a heat exchanger for evaporation, and a heat exchanger for condensation in a refrigeration cycle constituting a refrigerating air conditioner and a method of controlling the refrigeration cycle.

2. Discussion of Background

FIG. 14 schematically shows a refrigeration circuit of a conventional multi-chamber type air conditioner disclosed in JP-A-8-2534926. In FIG. 14, numerical reference 31 designates an outdoor unit; numerical reference 32 designates a variable capacity compressor; numerical reference 33 designates a four-way valve; numerical reference 34 designates an outdoor heat exchanger; numerical reference 37 designates a distributor; numerical references 41*a* through 41*c* designate three indoor units; numerical references 42*a* through 42*c* designate indoor electronic expansion valves; numerical references 43*a* through 43*c* designate electromagnetic switching valves; numerical references 44*a* through 44*c* designate electromagnetic switching valves; numerical reference 45 designates a controller; numerical reference 46 designates an outdoor blower; numerical reference 47 designates an electronic expansion valve; numerical references 48*a* through 48*c* designate indoor heat exchangers; numerical reference 49 designates a gas-liquid separator; numerical references 51 and 52 designate connection pipes for connecting the outdoor unit 31 to the distributor 37; numerical reference 53 designates a high-pressure pipe in the distributor 37; numerical reference 54 designates a low-pressure pipe in the distributor 37; numerical reference 55 designates an intermediate pressure pipe; numerical reference 56 designates a four-way valve; numerical reference 57 designates an accumulator; numerical reference 58 designates a pressure detector for a high pressure; and numerical reference 59 designates a pressure detector for a low pressure.

The distributor 37 and each of the indoor units 41*a* through 41*c* are connected by two pipes. The indoor units 41*a* through 41*c* are composed of the indoor heat exchangers 48*a* through 48*c* and the electronic expansion valves 42*a* through 42*c,* wherein the electronic expansion valves 42*a* through 42*c* are connected to the intermediate pressure pipe 55, and the indoor heat exchangers 48*a* through 48*c* are connected to the low-pressure pipe 54 and the high-pressure pipe 53 through the electromagnetic switching valves 43*a* through 43*c* and 44*a* through 44*c*. Further, the pressure detectors 58 and 59 are installed in the outdoor unit 31, wherein detection signals from the pressure detectors are inputted in the controller 45. The controller 45 controls a capability of exchanging heat between a refrigerant circulating in piping and the outdoor heat exchanger 34 using the compressor 32, the four-way valve 33, and the blower 46.

In the next, operation will be described. A case that the indoor unit 41*a* is in a heating mode and the indoor units 41*b* and 41*c* in a cooling mode will be described. A high-temperature high-pressure gas refrigerant compressed by the compressor 32 passes through the four-way valve 33 and is partially condensed by the outdoor heat exchanger 34 to be transformed into a two-phase refrigerant. Thereafter, the refrigerant passes through the high-pressure connection pipe 51 and flows into the distributor 37 located in a room.

The two-phase refrigerant in the distributor 37 passes through the four-way valve 56 and is separated into a gas and a liquid by the gas-liquid separator 49. Thus obtained high-pressure gas refrigerant flows into the indoor unit 41*a* through the electronic switching valve 44*a,* and dissipates heat to be condensed by the indoor heat exchanger 48*a*. Thereafter, the refrigerant flows into the intermediate pressure pipe 55 through the electronic expansion valve 42*a* and joins with a liquid refrigerant flowing into the intermediate pressure pipe. from a liquid-phase portion through the electronic expansion valve 47 and flows into the indoor units 41*b* and 41*c*. In the indoor units 41*b* and 41*c,* the refrigerant is respectively changed to have a low pressure by the electronic expansion valves 42*b* and 42*c* and is endothermically evaporated by the indoor heat exchangers 48*b* and 48*c*. Thereafter, it joins with the low-pressure pipe 54 through the electromagnetic switching valves 43*b* and 43*c*. Further, it passes through the four-way valve 56 and circulates by passing through the low-pressure connection pipe 52, the four-way valve 33, and the accumulator 57 and returning to the compressor 32. As described, a refrigeration circuit for simultaneously heating and cooling, in which a cooling operation is conducted in the indoor heat exchanger 48*a* and a heating operation is conducted in the indoor heat exchangers 48*b* and 48*c,* is realized.

In the above refrigeration circuit, a high pressure discharged from the compressor 32 and a low pressure sucked by the compressor 32 are detected by the pressure detector 58 provided in the high-pressure pipe in the outdoor unit 31 and the pressure detector 59 provided in the low-pressure pipe, and the result of this detection is transmitted to the controller 45. The controller 45 compares each detected value respectively with preset high-pressure or low-pressure target value after receiving signals transmitted from the detectors 58 and, 59. Further, the controller 45 calculates a requisite capacity of the compressor 32 based on a result of this comparison and a requisite capacity of the outdoor heat exchanger 34 based on a result of this calculation. Further, the controller 45 controls a capacity of compressor 32 based on the result of this calculation and simultaneously controls a capability of exchanging heat in the outdoor heat exchanger 34 by adjusting the revolutional numbers of the blower 46.

Further, when a variation of a load is estimated large, a capacity of the compressor 32 and a capacity of the outdoor heat exchanger 34 are controlled and simultaneously the four-way valve 33 is switched based on determination of whether or not the outdoor heat exchanger 34 is used as a condenser of heat dissipator or as an evaporator of heat absorber from the result of calculation, whereby a drastic variation of the load is managed.

By such a control, it is possible to deal with changes of a load on an outdoor unit side in response to environmental conditions of weather and a climate, opening and closing of side doors of the indoor units 41*a* through 41*c,* a change of a preset indoor temperature, and a change of the load of the indoor unit caused by switching between cooling and heating modes.

In controlling thus constructed conventional multi-chamber type air conditioner, the high-pressure target value and the low-pressure target value necessary for calculating a degree of controlling the compressor, of the outdoor heat exchanger, and of the four-way valve were fixedly preset in designing the refrigeration cycle and were constant regardless of a preset value of indoor air temperature and an outdoor air temperature.

Specifically, the high-pressure target value and the low-pressure target value were set so as to be able to deal with a large load for obtaining a general purpose apparatus which can deal with any load.

Since the method of controlling the conventional multi-chamber type air conditioner had the above-mentioned structure and operation, the air conditioner was not always energy-saving as a whole as long as the capability for exchanging heat of the indoor heat exchangers 41*a* through 41*c* were not controlled by the controller 45 in the outdoor unit 31.

Further, energy consumption of the compressor 32, which occupied the largest ratio in the entire energy consumption of the air conditioner, was substantially constant irrespective of the preset value of indoor air temperature and an outdoor air temperature. For example, in case that the preset value of indoor air temperature was high or an outdoor air temperature was low at a time of cooling operation, it was possible to save energy. However, there was a problem that the energy was not sufficiently saved.

SUMMARY OF THE INVENTION

It is an object of the present invention to solve the above-mentioned problems inherent in the conventional technique and to provide an apparatus for controlling a refrigeration cycle and a method of controlling the refrigeration cycle, by which a proper capability of the refrigeration cycle can be quickly obtained under a running condition and the running condition can be controlled so as to save energy. For example, the object of the present invention is to obtain the apparatus of controlling the refrigeration cycle and the method of controlling the refrigeration cycle, by which a high-pressure detection value and a low-pressure detection value of the refrigeration cycle can be quickly converged in to a high-pressure target value and a low-pressure target value respectively under a running condition, and energy consumption of an entire air conditioner can be minimized within an allowable range for attaining a target under a running condition.

Another object of the present invention is to obtain an apparatus of controlling a refrigeration cycle and a method of controlling the refrigeration cycle, by which a high-pressure target value and a low-pressure target value used for converging into a preset temperature in a heat exchanger on a user side and a control for assuring a capability can be automatically set and properly changed in response to running conditions.

According to a first aspect of the present invention, there is provided an apparatus for controlling a refrigeration cycle of circulating a refrigerant in a compressor, a heat exchanger for condensation, a flow rate control valve, and a heat exchanger for evaporation, connected each other, comprising: a first means for changing a capability of exchanging heat of the heat exchanger for condensation, a second means for changing a capability for exchanging heat of the heat exchanger for evaporation, a means for operating a running capacity of the compressor, and a control means for reducing a difference between a running condition of the refrigeration cycle on a high pressure side or a low pressure side and a target.

According to a second aspect of the present invention, there is provided the apparatus for controlling the refrigeration cycle, wherein the control means works to minimize a consumption energy in the smallest one of the differences between the running condition on the high pressure side or the low pressure side and the target.

According to a third aspect of the present invention, there is provided the apparatus for controlling the refrigeration cycle, wherein the control means works to make a difference between an inlet temperature and an outlet temperature of a heat exchanging fluid of a heat exchanger on a user side, being one of the heat exchanger for condensation and the heat exchanger for evaporation, to reach or approach to a target of temperature difference.

According to a fourth aspect of the present invention, there is provided the apparatus for controlling the refrigeration cycle, wherein the running condition on the high pressure side of the refrigeration cycle is under a discharge pressure of the compressor or a saturation temperature corresponding to this discharge pressure; and the running condition on the low pressure side of the refrigeration cycle is under a suction pressure of the compressor or a saturation temperature corresponding to this suction pressure.

According to a fifth aspect of the present invention, there is provided the apparatus for controlling the refrigeration cycle, wherein the running condition on the high pressure side of the refrigeration cycle is under a condensation pressure of the condenser or a saturation temperature corresponding to this condensation pressure; and the running condition on the low pressure side of the refrigeration cycle is under an evaporation pressure of the evaporator or a saturation temperature corresponding to this evaporation pressure.

According to a sixth aspect of the present invention, there is provided the apparatus for controlling the refrigeration cycle, further comprising: a target value setting means for automatically setting one of target values of the running conditions on the low pressure side and the high pressure side of the refrigeration cycle in reference of a preset value of an inlet temperature or an outlet temperature of heat exchanging fluid in a heat exchanger on a user side and automatically setting the other of the target values in reference of a temperature of heat source.

According to a seventh aspect of the present invention, there is provided the apparatus for controlling the refrigeration cycle further comprising: a target value changing means for increasing or decreasing the target value on the low pressure side in reference of a relationship between the running condition on the low pressure side in a stable running condition of the refrigeration cycle and the target value on the low pressure side, wherein the heat exchanger for evaporation is the heat exchanger on the user side.

According to an eighth aspect of the present invention, there is provided the apparatus for controlling the refrigeration cycle further comprising: a target value changing means for increasing and decreasing the target value on the high pressure side in reference of a relationship between the running condition on the high pressure side in a stable running condition of the refrigeration cycle and the target value on the high pressure side, wherein the heat exchanger for condensation is the heat exchanger on the user side.

According to a ninth aspect of the present invention, there is provided the apparatus for controlling the refrigeration cycle, wherein the target value changing means increases and decreases the target value on the high pressure side or the low pressure side of the refrigeration cycle based on a relationship between the inlet temperature of the heat exchanging fluid in the heat exchanger on the user side in a stable running condition and the target value, and on a relationship between the outlet temperature of the heat exchanging fluid in the heat exchanger on the user side and the target value.

According to a tenth aspect of the present invention, there is provided a method of controlling a refrigeration cycle comprising: a step of making a parameter of degree of change from various capacities in a compressor based on changes of running conditions on a high pressure side or a low pressure side of the refrigeration cycle in response to the degrees of change of the various capacities of the compressor, a step of obtaining standard degrees of change of capabilities for exchanging heat of heat exchangers for condensation and evaporation so as to make the capabilities for exchanging heat be target values in the running condition on the high pressure side and the low pressure side of the refrigeration cycle by varying the capabilities for exchanging heat with respect to the degrees of change of the various capacities of the compressor, made as the parameter, a step of producing a plurality of degrees of change based on the obtained standard degrees of change, a step of operating the plurality of degrees of change when the plurality of degree of change of the heat exchangers for condensation and evaporation respectively make the capabilities of the heat exchangers to exceed their allowable capabilities for exchanging heat so that the plurality of degrees of change makes the capabilities involved within their allowable capabilities for exchanging heat, and a step of selecting degrees of change among the plurality of degrees of change of the capabilities for exchanging heat obtained with respect to the parameter, which degrees of change make the capabilities of exchanging heat to approach to the target value of the running condition on the high pressure side or the low pressure side.

According to an eleventh aspect of the present invention, there is provided a method of controlling a refrigeration cycle comprising: a step of operating degrees of change making a running capacity of compressor and throughput capacities of heat exchangers for condensation and evaporation to approach to a target on a low pressure side or a high pressure side by changing the running capacity of compressor and the throughput capacities of heat exchangers for condensation evaporation using a difference between the target on the low pressure or high pressure side and a current running condition, and a step of selecting degrees of change making the running capacity and the throughput capacities to maximally approach to the target on the low pressure or high pressure side among the degrees of change.

According to a twelfth aspect of the present invention, there is provided the method of controlling the refrigeration cycle, further comprising: a step of selecting a combination of the degrees of change making a consumption energy minimize by controlling the degrees of change of the running capacity of the compressor and the degrees of change of the capabilities for exchanging heat in the heat exchangers for condensation and evaporation.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 6 is a table for showing preferable combinations of manipulated variables of the running frequency of compressor F, the throughput capacity of indoor heat exchanger BK, and the throughput capacity of outdoor heat exchanger AK according to Embodiment 1 of the present invention;

FIG. 10 is a flow chart for explaining steps of operating a control means 15 according to Embodiment 2 of the present invention;

DETAILED DESCRIPTION OF THE PREFERRED EMBODIMENTS

A detailed explanation will be given of preferred embodiments of the present invention in reference to FIGS. 1 through 14 as follows, wherein the same numerical references are used for the same or the similar portions and description of these portion is omitted.

Embodiment 1

Generally, in a refrigeration cycle, a refrigerant is circulated in a compressor, a heat exchanger for condensation, a flow rate control valve, and a heat exchanger for evaporation connected each other. In such a structure, a high-temperature high-pressure gas refrigerant compressed in and discharged from the compressor is condensed and liquefied in the heat exchanger for condensation. At this time, the refrigerant dissipates heat to a heat exchanging fluid in the heat exchanger for condensation. Further, it is choked by the flow rate control valve to be a low-pressure two-phase state and flows into the heat exchanger for evaporation to be vaporized and gasified. The refrigerant absorbs heat from a heat exchanging fluid in the heat exchanger for evaporation. Thereafter, the refrigerant is again sucked in the compressor.

In operating the refrigeration cycle, piping from a discharge side of the compressor to the heat exchanger for condensation is a high pressure side, in which the high-temperature high-pressure gas refrigerant flows, and piping from the heat exchanger for evaporation to a suction side of the compressor is a low pressure side, in which the low-temperature low-pressure gas refrigerant flows.

At a time of cooling operation, the heat exchanger for evaporation is installed on an indoor side as a heat exchanger on a user side, wherein a heat exchanging fluid, for example, an air in a space having the heat exchanger for evaporation exchanges heat with the refrigerant. Thus, the refrigerant cools an indoor by evaporating and gasifying. The heat exchanger for condensation is installed on an outdoor side as a heat exchanger on a heat source side. In a single air conditioner having dual functions of cooling and heating, a heat exchanger installed on an indoor side is operated as a heat exchanger for evaporation at a time of cooling and a heat exchanger for condensation is operated as a heat exchanger for condensation at a time of heating. For this, a four-way valve is installed in a middle of a refrigeration circuit to switch directions of circulating the refrigerant.

Figure 1:
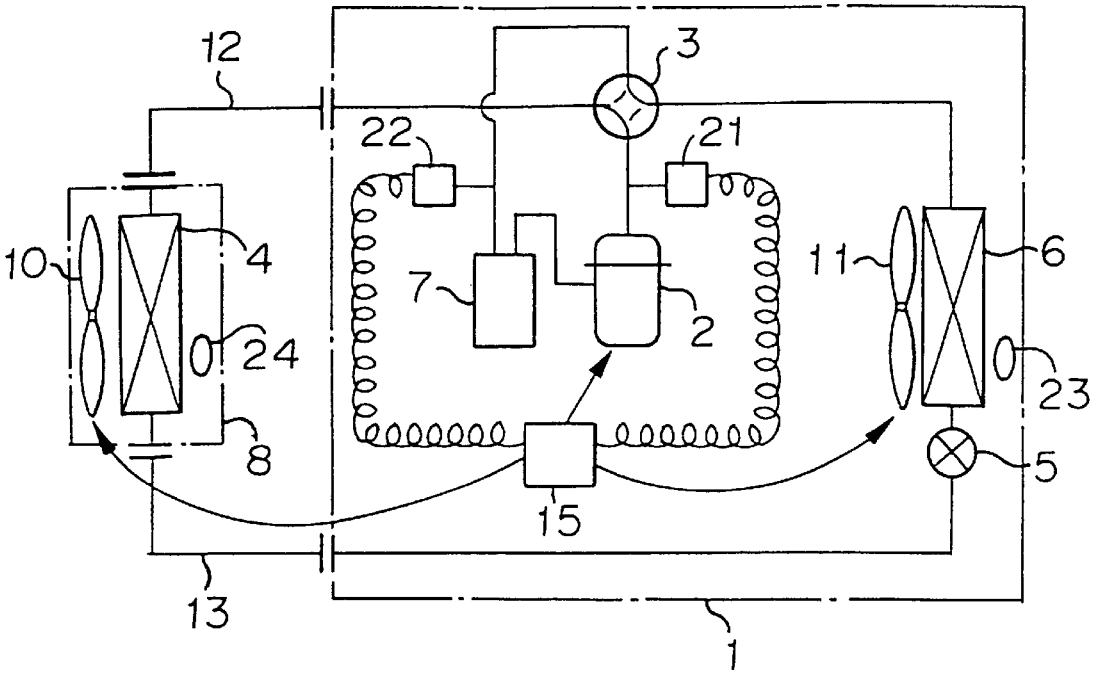
FIG. 1 is a refrigeration circuit diagram for illustrating an air conditioner apparatus according to Embodiment 1 of the present invention.

Hereinbelow, a method of controlling a refrigeration cycle according to Embodiment 1 of the present invention will be described. An example of an air conditioner utilizing the method of controlling the refrigeration cycle of the present invention for air-conditioning a communication operating room, specifically, in a control operation in cooling will be described. FIG. 1 is a circuit diagram of refrigeration circuit of an air conditioner according to Embodiment 1 of the present invention.

In FIG. 1, numerical reference 2 designates a compressor; numerical reference 3 designates a flow path switching valve, for example, a four-way valve; numerical reference 5 designates a flow rate control valve; numerical reference 6 designates a heat exchanger, an indoor heat exchanger in FIG. 1; numerical reference 7 designates an accumulator; and numerical reference 11 designates a blower, an indoor blower in this case, wherein these are accommodated in an inside of an indoor unit 1. Numerical reference 4 designates a heat exchanger, an indoor heat exchanger in FIG. 1; and numerical reference 10 designates a blower, an indoor blower in FIG. 1, wherein these are accommodated in an outdoor unit 8. The indoor unit 1 and the outdoor unit 8 are connected by a gas pipe 12 and a liquid pipe 13 to thereby constitute the refrigeration cycle. A first port of the flow path switching valve 3 is connected to a discharge side of the compressor 2; a third port of the flow path switching valve 3 is connected to the accumulator 7; a second port thereof is connected to the gas pipe 12 further connected to the outdoor heat exchanger 4; and a fourth port thereof is connected to the indoor heat exchanger 6.

Numerical reference 15 designates a control means; numerical reference 21 designates a pressure detector for high pressure; numerical reference 22 designates a pressure detector for low pressure; and numerical reference 23 designates an inlet temperature detector for a heat exchanging fluid installed in the indoor unit 1, for example, a suction air temperature detector. It detects a temperature of an indoor air as the heat exchanging fluid in the indoor heat exchanger 6 at an inlet of the indoor heat exchanger 6. Numerical reference 24 designates a temperature detector installed in the outdoor unit 8, for example, an outdoor air temperature detector. It detects a temperature of an outdoor air as the heat exchanging fluid in the outdoor heat exchanger 4 at an inlet of the outdoor heat exchanger 4. The control means 15 operates a running capacity of the compressor 2, a capability of exchanging heat of the indoor heat exchanger 6 as a throughput capacity, and a capability of exchanging heat of the outdoor heat exchanger 4 as a throughput capacity, in response to a detection value of high pressure obtained by the pressure detector for high pressure 21 and a detection value of low pressure obtained by the pressure detector for low pressure 22.

An operation of cooling by thus constructed air conditioner will be described. At a time of cooling, the flow path switching valve 3 is configurated to connect the first port to the second port and the third port to the fourth port. For cooling, the indoor heat exchanger 6 on a user side is served as the heat exchanger for evaporation and the outdoor heat exchanger 4 on a heat source side is served as the heat exchanger for condensation.

A high-temperature high-pressure gas refrigerant compressed by and discharged from the compressor 2 flows into the outdoor heat exchanger 4 through the flow path switching valve 3 and the gas pipe 12. In the outdoor heat exchanger 4, an outdoor air as the heat exchanging fluid received from the outdoor blower 10 is sucked; heat is exchanged between the refrigerant and the outdoor air; and the refrigerant is condensed and liquefied. This liquid refrigerant arrives at the flow rate control valve 5 in the indoor unit 1 through the liquid pie 13, is choked to be a low-pressure two-phase refrigerant, and flows into the indoor heat exchanger 6. In the indoor heat exchanger 6, the low-pressure two-phase refrigerant exchanges heat with an indoor air as the heat exchanging fluid received from the indoor blower 11, whereby the refrigerant is evaporated and gasified. This gas refrigerant flows into the accumulator 7 through the fourth port and the third port of the flow path switching valve 3 and is again sucked by the compressor 2. The refrigeration cycle is completed as described.

Figure 2:
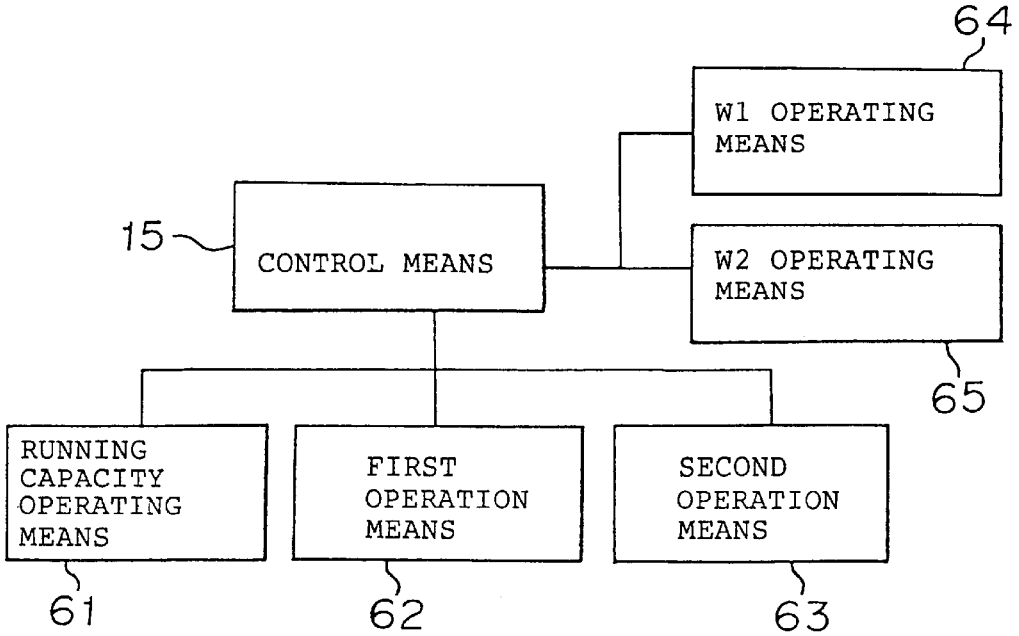
FIG. 2 is a block chart for illustrating a structure of a controlling device of a refrigeration cycle according to Embodiment 1 of the present invention.

An apparatus for controlling a running condition, by which a proper capability is obtainable and energy is saved, for the above-mentioned refrigeration circuit will be described. FIG. 2 is a block diagram for illustrating a structure of the apparatus for controlling the refrigeration cycle according to Embodiment 1. In FIG. 2, numerical reference 61 designates a means for operating a running capacity of the compressor 2, for example, an operating means for changing a running frequency of the compressor 2. Numerical reference 62 designates a first operation means for changing a capability of exchanging heat, i.e., a throughput capacity, of the heat exchanger for condensation 4, for example, a control means for changing the number of revolutions of the outdoor blower 10 in FIG. 1. Numerical reference 63 designates a second operation means for changing a capability of exchanging heat, i.e., a throughput capacity, of the heat exchanger for evaporation 6, for example, an operation means for changing the number of revolutions of the indoor blower 11 in FIG. 1. Numerical reference 64 designates a means for operating an indication W1 representing a distance between a target and a running state; and numerical reference 65 designates a means for operating an energy consumption W2.

In Embodiment 1, a target value of an evaporation temperature or a low pressure value for the refrigeration cycle is previously set, and a target value of a condensation temperature or a high pressure value is previously set. With respect to these target values, the running capacity control means 61 for changing a running frequency F [Hz] as a running capacity of the compressor 2, the first operation means 62 for changing the heat exchanging capability, i.e., a throughput capacity AK [W/°C.] of the outdoor heat exchanger 4, and the second operation means 63 for changing the heat exchanging capability, i.e., a throughput capacity BK [W/°C.] of the indoor heat exchanger 6 are controlled. Hereinbelow, the heat exchanging capability of the outdoor heat exchanger 4 is referred to as the throughput capacity AK of the outdoor heat exchanger 4, and the heat exchanging capability of the indoor heat exchanger 6 is referred to as the throughput capacity BK. The above-mentioned control is performed to bring a detection value of high pressure Pc detected by the pressure detector 21 into an allowable range having a predetermined deviation larger and smaller than a target value of high pressure Pcm [Pa] previously set, and simultaneously a detection value of low pressure Pe detected by the pressure detector 22 into an allowable range having a predetermined deviation larger and smaller than a target value of low pressure Pem [Pa] previously set so that a running condition minimizing a consumption energy of the entire refrigeration cycle, namely an electric power consumption, is controlled to be within the allowable ranges including the target values.

Hereinbelow, the capacity of the compressor 2 is controlled by driving an inverter. A flow rate of the refrigerant controlled by the flow rate control valve 5 is controlled by a super-heat controlling method so that a degree of super heat of the refrigerant at an outlet of the indoor heat exchanger becomes a preset target value in case of cooling operation apart from the control by the control means 15. In case of heating operation, the flow rate of the refrigerant is controlled by a subcool controlling method so that a degree of super cool at the outlet of the indoor heat exchanger becomes a preset target value apart from the control by the control means 15.

In the next, basic characteristics of the refrigeration cycle will be described. Based on a current running condition of the refrigeration cycle, degrees of change ΔPc [Pa] and ΔPe [Pa] of the detection value respectively of a high pressure value [Pa] and a low pressure value [Pa] are approximately represented by following Equations 1 and 2 in case of changing manipulated variables of compressor running frequency, the throughput capacity of the outdoor heat exchanger, and the throughput capacity of the indoor heat exchanger respectively as much as ΔF [Hz], ΔAK [W/°C.], and ΔBK [W/°C.].

$$\Delta Pc=a\cdot\Delta F+c\cdot\Delta BK+e\cdot\Delta AK; \quad \text{(Equations 1)}$$

and $$\Delta Pe=b\cdot\Delta F+d\cdot\Delta BK+f\cdot\Delta AK, \quad \text{(Equations 2)}$$

where reference Pc designates a high pressure discharged from compressor 2 [Pa];

reference Pe designates a low pressure sucked by compressor 2 [Pa];

reference Δ designates a degree of change;

reference F designates a running frequency of compressor 2 [Hz];

reference BK designates a throughput capacity of indoor heat exchanger 6 [W/°C.]; and reference AK designates a throughput capacity of outdoor heat exchanger 4 [W/°C.]

In the above Equations, references a, b, c, d, e, and f designate quotients previously determined in conformity with the characteristics of the air conditioner, based on the compressor running frequency, the throughput capacity of the outdoor heat exchanger, the throughput capacity of the indoor heat exchanger, the outdoor air temperature, the indoor air temperature, the high pressure value or a condensation temperature, the low pressure or an evaporation temperature, and so on. In case of cooling, the quotients b, e, and f are negative, and the quotients a, c, and d are positive.

Figure 3A:
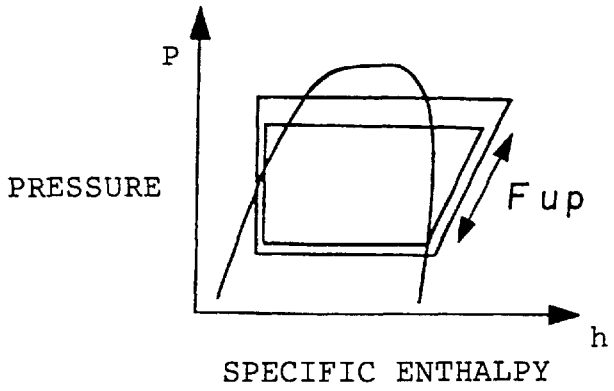
FIG. 3*a* is a graph for illustrating characteristic curves concerning a change of a pressure P with respect to specific entropy of running capacity F according to Embodiment 1 of the present invention.
Figure 3B:
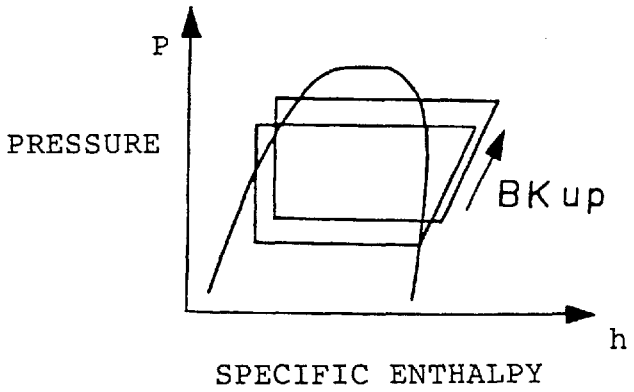
FIG. 3*b* is a graph for illustrating characteristic curves concerning a change of the pressure P with respect to a throughput capacity of indoor heat exchanger BK according to Embodiment 1 of the present invention.
Figure 3C:
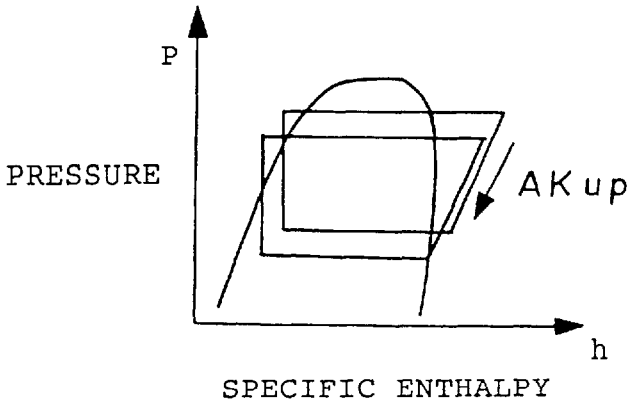
FIG. 3*c* is a graph for illustrating characteristic curves concerning a change of the pressure P with respect to a throughout capacity of outdoor heat exchanger AK according to Embodiment 1 of the present invention.

FIGS. 3*a* through 3*c* are diagrams illustrating the basic characteristics of the refrigeration cycle, wherein the abscissa represents specific enthalpy and the ordinate represents a pressure. FIG. 3*a* illustrates a change of the characteristics at a time of changing the running frequency F of the compressor; FIG. 3*b* illustrates a change of the characteristics at a time of changing the throughput capacity BK of the indoor heat exchanger 6; and FIG. 3*c* illustrates a change of the characteristics at a time of changing the throughput capacity AK of the outdoor heat exchanger 4.

For example, in case of increasing the running frequency F of the compressor by ΔF [Hz], the high pressure value is increased from a current value Pc [Pa] to Pc+ΔPc [Pa] by ΔPc=a·ΔF [Pa], and the low pressure value is decreased from a current value Pe [Pa] to Pe+ΔPe [Pa] by ΔPe=b·ΔF [Pa]. Such changes occur because b<0 and therefore ΔPe<0.

Further, in case of increasing only the throughput capacity of the indoor heat exchanger by ΔBK [W/°C.] as a result of an increment of the number of revolutions of the indoor blower or the like, the high pressure value is changed from the current value Pc [Pa] to Pc+ΔPc [Pa] by ΔPc=c·ΔBK [Pa], and the low pressure value is increased from the current value Pe [Pa] to Pe+ΔPe [Pa] by ΔPe=d·ΔBK [Pa], as indicated by an arrow in FIG. 3*b*.

Further, in case of increasing only the throughput capacity of the outdoor heat exchanger by ΔAK [W/°C.] by increasing the number of revolutions of the outdoor blower, the high pressure value is decreased from a current value Pc [Pa] to Pc+ΔPc [Pa] by ΔPc=e·ΔAK [Pa], and the low pressure value is increased from a current value Pe [Pa] to Pe+ΔPe [Pa] by ΔPe=f·ΔAK [Pa]. Such changes occur because e<0, f<0 and therefore ΔPc<0, ΔPe<0.

In case of heating, because the indoor heat exchanger 6 is positioned on a condensation side and the outdoor heat exchanger 4 is positioned on an evaporation side, quotients c and e are mutually replaceable in Equation 1 and the quotients d and f are mutually replaced in Equation 2, and quotients b, c, and d become negative and the quotients a, e, and f become positive. Accordingly, the characteristics of the throughput capacity BK of the indoor heat exchanger becomes as illustrated in FIG. 3*c*, and the characteristics of the throughput capacity AK of the outdoor heat exchanger become as illustrated in FIG. 3*b*.

In a practical operation, these changes may simultaneously occur. Therefore, Equations 1 and 2 indicate that changes adding these changes are reflected in the high pressure Pc and the low pressure Pe. However, the characteristics of the refrigeration cycle expressed by Equations 1 and 2 are about a case that degrees of change of the running frequency of the compressor 2, the throughput capability of the indoor heat exchanger 6, and the throughput capacity of the outdoor heat exchanger 4 are respectively small to a certain extent, for example, the degree of change of the running frequency of the compressor 2 is about 10% more or less than a current running frequency, wherein Equations 1 and 2 are approximate Equations representing a quantity of change to a next steady state. Accordingly, although it is necessary to consider responsiveness to time in a transient state just after starting and at a time of an abrupt change of a load, a degree of influence between an orientation of the change of running condition and the manipulated variables are correctly expressed by Equations 1 and 2.

Figure 4:
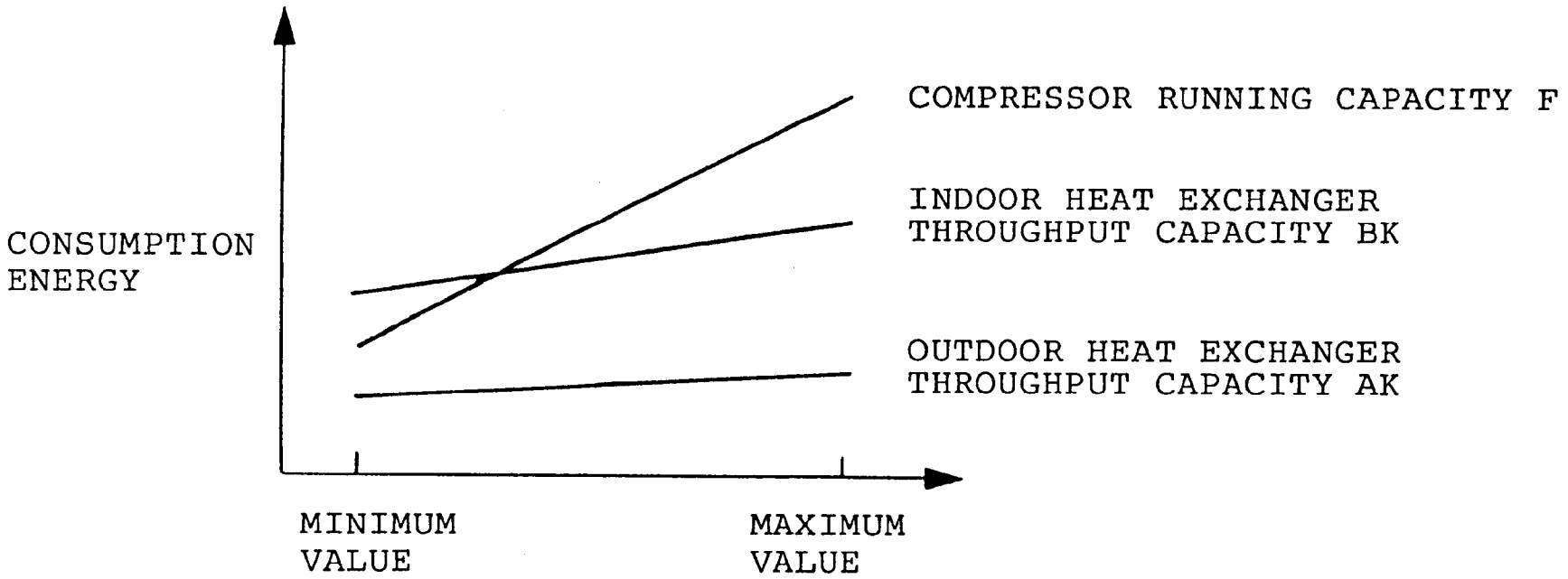
FIG. 4 is a graph for illustrating a relationship among a running frequency F of compressor, the throughput capacity of indoor heat exchanger BK, the throughput capacity of outdoor heat exchanger AK, and a consumption power according to Embodiment 1 of the present invention.

FIG. 4 is a graph illustrating a relationship between each value of the running frequency F of the compressor 2, the throughput capacity BK of the indoor heat exchanger 6, and the throughput capacity AK of the outdoor heat exchanger 4 and power consumption. The throughput capacities AK and BK respectively of the heat exchangers 4 and 6 are controlled by increasing and decreasing the numbers of revolutions of the blowers 10 and 11. The control means 15 controls these values to pursue energy saving in consideration of the relationships illustrated in FIG. 4. For example, even though the running frequency F of the compressor 2 is increased, energy may be saved by decreasing the throughput capacity BK of the indoor heat exchanger 6 or the throughput capacity AK of the outdoor heat exchanger 4 depending on a degree of change in the control, or the energy may be saved by increasing the throughput capacity BK of the indoor heat exchanger 6 or the throughput capacity AK of the outdoor heat exchanger 4 to achieve a change of the running condition similar to that obtainable by increasing the running frequency F of the compressor 2 instead of increasing the running frequency F.

Figure 5:
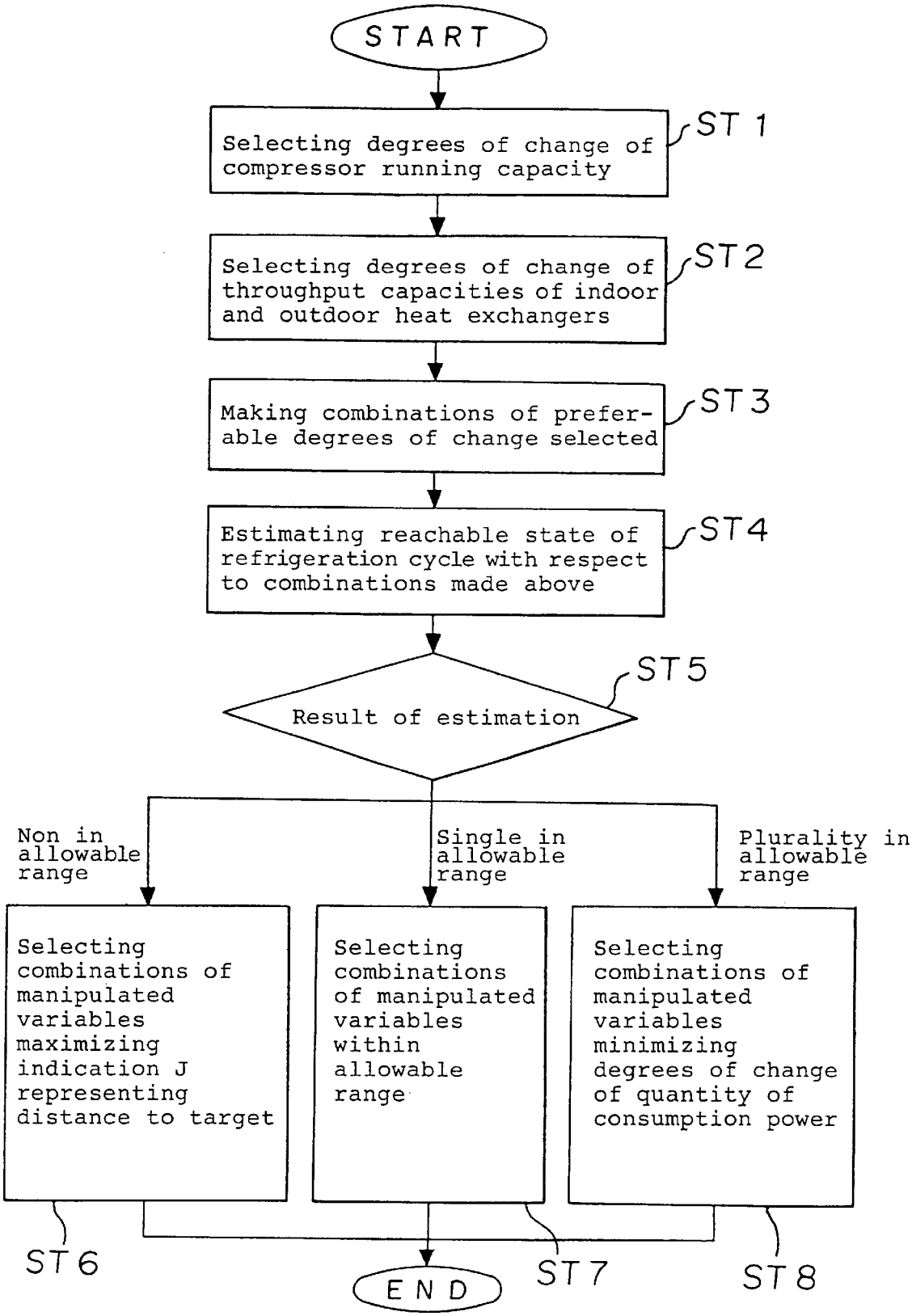
FIG. 5 is a flow chart for explaining steps of operating a control means 15 according to Embodiment 1 of the present invention.

Hereinbelow, a control method that the running frequency F of the compressor, the throughput capacity BK of the indoor heat exchanger, and the throughput capacity AK of the outdoor heat exchanger are respectively operated, the detection value of high pressure and the detection value of low pressure are respectively brought into the target value of high pressure Pcm [Pa] and the target value of low pressure Pem [Pa], and the entire air conditioner is controlled in a running state minimizing energy consumption of the entire air conditioner, will be specifically described. FIG. 5 is a flow chart showing steps of processing the control means 15, the flow chart is about after inputting the detection value of high pressure detected by the pressure detector for high pressure 21 and the detection value of low pressure detected by the pressure detector for low pressure 22.

In advance, an allowable range of target value is preset so as to have a predetermined deviation larger than the target value of high pressure Pcm and a predetermined deviation smaller than the target value of low pressure Pem. For example, in case of cooling, the allowable range of high pressure target value is made to be $Pc \geqq = Pcm$, and the allowable range of low pressure target value is made to be $Pem \times 0.95 \leqq Pe \leqq Pem \times 1.05$, whereby the detection value of high pressure Pc and the detection value of low pressure Pe are respectively brought into the allowable ranges of target values. In case of cooling, because the indoor is cooled by evaporation, an upper limit and a lower limit are determined with respect to the allowable range of low pressure target value and the range is set to be narrow. On the other hand, only a lower limit is determined with respect to the allowable range of high pressure target value and the range is set to be wide. In case of heating, because the indoor is heated by condensation, an upper limit and a lower limit are determined with respect to the allowable range of high pressure target value and the range is set to be narrow. On the other hand, only an upper limit is determined with respect to the allowable range of low pressure target value and the range is set to be wide.

In a step of ST1 in FIG. 5, several preferable values of the degrees of change ΔF, to be manipulated variables for the running capacity of compressor are selected. For example, the degrees of change ΔF necessary for bringing the detection values closer to the allowable range of low pressure target using only a change of the running capacity of compressor is obtained as reference ΔF max. ΔF max is expressed in Equation 3 from Equation 2.

$$\Delta Fmax = \Delta Pe/b, \qquad \text{(Equation 3)}$$

where $$\Delta Pe = Pem - Pe;$$

Pem designates target value of low pressure; and

Pe designates detection value of low pressure.

Further, in order to avoid an abrupt change of the running condition, the maximum value of the degree of change ΔFmax of the running capacity of the compressor 2 is limited. For example, the degree of change ΔF of the running capacity is 2 [Hz] or more and 10% or less of the running capacity at a time of running. The degrees of change ΔFmax satisfying these conditions are used as a standard to select preferable values of the degrees of change ΔF of the running capacity of the compressor 2. For example, seven preferable values are used as parameters as follows:

$$\Delta F\mathbf{1} = |\Delta F\max|,\ \Delta F\mathbf{2} = |\Delta F\max| \cdot 0.5,\ \Delta F\mathbf{3} = 1,\ \Delta F\mathbf{4} = 0,$$

$$\Delta F\mathbf{5} = -1,\ \Delta F\mathbf{6} = -|\Delta F\max| \cdot 0.5,\ \Delta F\mathbf{7} = -|\Delta F\max|.$$

Step ST1 uses the degrees of changes of various capacities of the compressor 2 as parameters in reference of changes of the running conditions on the low pressure side in the refrigeration cycle in response to the changes of the various capacities of the compressor 2, specifically, the degrees of change ΔF of the running capacity of the compressor 2 is obtained using a difference between the target value on the low pressure side of the refrigeration cycle and a current running condition as expressed by Equation 3 in this case. Further, in addition to setting of the degrees of change ΔFi (i=1–7) of the running capacity of compressor described above, a unit of degree of change can be preset to use as a parameter, for example, the numbers of frequency obtained by multiplying 1 Hz and integers like −8 Hz, −3 Hz, −1 Hz, 0, 1 Hz, 3 Hz, 8 Hz. However, in this case, values supposed to be proper are selected in consideration of a change of the running condition of low pressure of the refrigeration cycle responding to changes of various capacities of the compressor. However, the number of parameters are not limited to seven and can be any number as long as a plural number.

In the next, in step ST2, degrees of change of the throughput capacity BK of the indoor heat exchanger 6 and the throughput capacity AK of the outdoor heat exchanger 4 are selected, which are calculated by Equations 4 and 5 based on Equations 1, 2, and 3 with respect to ΔFi (i=1–7) selected in step ST1.

$$\Delta BK\max i = \{f \cdot \Delta Pc - e \cdot \Delta Pe + (b \cdot e - a \cdot f) \cdot \Delta Fi\}/(c \cdot f - d \cdot e), \qquad \text{(Equation 4)}$$

$$\Delta AK\max i = \{d \cdot \Delta Pc - c \cdot \Delta Pe + (b \cdot c - a \cdot d) \cdot \Delta Fi\}/(d \cdot e - c \cdot f), \qquad \text{(Equation 5)}$$

where $\Delta Pc = Pcm - Pc;$

Pcm designates a target value of high pressure;

Pc designates a detection value of high pressure;

$\Delta Pe = Pem - Pe;$

Pem designates a target value of low pressure; and

Pe designates a detection value of low pressure.

Further, in order to avoid an abrupt change of a running condition, the maximum values ΔBKmaxi and ΔAKmaxi of the degrees of change of the throughput capacities of the heat exchangers 6 and 4 are limited so that the degrees of change of the heat exchangers 6 and 4 do not exceed allowable throughput capacities. For example, the degrees of change of the throughput capacities is 5% or less of throughput capacities at a time of running under 1 [kW/°C.]. Preferable values of the degrees of change ΔBK and ΔAK of the throughput capacities of the heat exchangers 6 and 4 are selected using ΔBKmaxi and ΔAKmaxi satisfying this condition as standard degrees of change. For example, three preferable values are selected by multiplying a plurality of real numbers and the standard degree of change ΔBKmaxi, specifically three real numbers of 1.0, 0.0, and −1.0 to obtain ΔBKi1=|ΔBKmaxi|, ΔBKi2=0, and ΔBKi3=−|ΔBKmaxi|. Also the standard degrees of change ΔAKmaxi are multiplied by a plurality of real numbers, for example, 1.0, 0.0, and −1.0 to thereby obtain three preferable values like ΔAKil=|ΔAKmaxi|, ΔAKi2=0, and ΔAKi3=−|ΔAKmaxi|. In this, the degrees of change ΔFi of the compressor 2 are used as parameters, where i=1, 2, . . . , 7.

Step ST2 includes a step of obtaining the standard degrees of change ΔBKmaxi and ΔAKmaxi of the throughput capacities by respectively changing the throughput capacities of the heat exchanger for condensation and the heat exchanger for evaporation with respect to the degrees of change ΔFi (i=1–7) of the various capacities of the compressor obtained as parameters to attain target values of the running condition of high pressure and the running condition of low pressure in Equations 4 and 5, a step of producing a plurality of the degrees of change ΔAKij and ΔBKik by multiplying thus obtained standard degrees of change ΔBKmaxi and ΔAKmaxi and a plurality of real numbers, and a step of operating the plurality of the degrees of change respectively of the heat exchanger for condensation and the heat exchanger for evaporation so that these do not exceed the throughput capacities when the plurality of the degrees of change are not accommodated in the allowable throughput capacities.

Incidentally, although the standard degrees of change ΔBKmaxi and ΔAKmaxi are operated so as not to exceed the allowable throughput capacities, it is also possible to operate the plurality of the degrees of change ΔAKij and ΔBKik produced from the standard degrees of change so as not to exceed the allowable throughput capacities.

In ST3, combinations of the preferable values selected in ST1 and ST2 are produced. The seven ΔFi selected in ST1 and ST2, the three ΔBKij, and the three ΔAKik are used to make combinations of manipulated variables as much as 63 sets as illustrated in FIG. 6, where i=1–7, j=1–3, and k=1–3.

In step ST4, an extent of changes of high pressure value and low pressure value in a current refrigeration cycle is calculated based on Equations 1 and 2 with respect to 63 sets combinations of the manipulated variables obtained in ST3; resultant high pressure value and resultant low pressure value are calculated; and a resultant situation of the refrigeration cycle is estimated. A result of calculation of the high pressure value is represented by Pcijk, and a result of calculation of the high pressure value is represented by Peijk, where i=1–7, j=1–3, and k=1–3.

The resultant situation, i.e., Pcijk and Peijk (i=1–7, j=1–3, and k=1–3 estimated in ST4 is determined whether or not Pcijk is within the allowable range of high pressure target value by satisfying Pcijk≧Pcm and Peijk is within the allowable range of low pressure target value by satisfying Pem×0.95≧Peijk≧Pem×1.05 in ST5. Further, a resultant situation satisfying the allowable ranges of high pressure target value and low pressure target value are picked out of the estimated resultant situation.

In a case that there is no resultant situation of Pcijk and Peijk involved in the allowable ranges of high pressure target value and low pressure target value, step ST6 is processed. Namely, an indication W1ijk representing a distance to the target values of high pressure and low pressure is calculated by Equation 6 in the W1 operating means 65.

$$W1ijk = 1 - C\{A(Pcm - Pcijk)^2 + B(Pem - Peijk)^2\} \quad \text{(Equation 6)}$$

In this, combinations of the manipulated variables ΔFi, ΔBKij, and ΔAKik providing a combination of Pcijk and Peijk maximizing the indication W1ijk (i=1–7, j=1–3, and k=1–3, representing the distances to the high pressure target value Pcm and the low pressure target value Pem, the distance expressed by Equation 6, are selected.

In Equation 6, W1ijk becomes smaller than 1 as the combination of (Pcijk, Peijk) is departed from the target values of (Pcm, Pem), where C>0 and constantly W1ijk≦1. Differences A and B are respectively weights of high pressure and low pressure, wherein in case of a cooling operation, these may be set to be A=0 and B=1; and when it is desirable to converge the low pressure value to the target value earlier than the high pressure value, these may be set to be A=0.1 and B=0.9. Further, in case of heating, because the high pressure value desirably converge into the target value earlier than the low pressure value, these may be set to be A=0.5 and B=0.5. Incidentally, a quoitent C changes an absolute value of W1ijk and does not influence a ratio between combinations of the manipulated variables. However, when it is required to avoid W1ijk<0 in a practical application, the quoitent C is set to be small, for example, 1/2000. In Equation 6, the indication W1ijk is only for the low pressure target in case of A=0, wherein the low pressure value in a running state of the refrigeration cycle is brought into the low pressure target value. In case of a cooling operation, it is possible to control using only the low pressure target value as described above. On the other hand, the indication W1ijk is only for the high pressure target in case of B=0, wherein the high pressure value in a running state of the refrigeration cycle is brought into the high pressure target value. In case of a heating operation, it is possible to control using only the high pressure target value as described above.

When the resultant state of (Pcijk, Peijk) involved in both of the allowable ranges of high pressure target value and low pressure target value is unique, ST7 is processed, wherein combinations of (ΔFi, ΔBKij, ΔAKik) of the manipulated variables satisfying the combination (Pcijk, Peijk) are selected.

ST6 and ST7 constitute steps of selecting combinations (ΔFi, ΔBKij, ΔAKik) of degrees of change, by which the high pressure value and the low pressure value approach the target values of high pressure and low pressure in use of the degrees of change of throughput capacities obtained with respect to each of the various parameters.

Further, when there are a plurality of combinations (Pcijk, Peijk), both are involved in the allowable ranges of high pressure target value and low pressure target value, ST8 is processed. Namely, the total amount of power consumption W2ijk of the air conditioner is operated by Equation 7 in the W2 operating means 65, and combinations (ΔFi, ΔBKij, ΔAKik) of the manipulated variables minimizing the total amount of power consumption W2ijk are selected.

$$W2ijk=g\cdot Fi+h\cdot BRij+1\cdot ARik \quad \text{(Equation 7)}$$

$$Fi=F+\Delta Fi$$

$$BRij=BR+\Delta BRij$$

$$ARik=AR+\Delta ARik,$$

where

BR designates the number of revolutions of indoor blower 11 at present;

AR designates the number of revolutions of outdoor blower 10 at present;

ΔBRij designates degrees of change of the number of revolutions of indoor blower 11 effecting degrees of change ΔBKij of throughput capacity of indoor heat exchanger 6;

ΔARij designates degrees of change of the number of revolutions of outdoor blower 10 effecting degrees of change ΔAKij of throughput capacity of outdoor heat exchanger 4;

g designates an increased amount of power consumption [W] in case of increasing running frequency F of compressor 2 by 1 [Hz]; h designates an increased amount of power consumption [W] in case of increasing the number of revolutions of indoor blower 11 by 1 [revolution] in response to change of throughput capacity of indoor heat exchanger 6; and l designates increased amount of power consumption [W] in case of increasing the number of revolutions of outdoor blower 10 by 1 [revolution] in response to change of throughput capacity of outdoor heat exchanger 4, wherein the references g, h, and l are previously determined by tests.

In ST8, combinations (ΔF, ΔBK, ΔAK) of the degrees of change minimizing consumption energy are selected by operating the degrees of change ΔF of running capacity of the compressor, the degrees of change ΔAK of the throughput capacity of the heat exchanger for condensation, and the degrees of change ΔBK of the throughput capacity of the heat exchanger for evaporation.

Further, in Embodiment 1, the control means 15, the W1 operating means 64, and the W2 operating means 65 are included in a processing unit of microcomputer and so on. Such a microcomputer is disposed in a casing accommodating electric apparatuses.

Apart from a control by the control means 15, an on-off control of stopping a cooing operation when a detected temperature of suction air detected by the suction air temperature detector becomes smaller than a preset target value of indoor air temperature determined by a user or the like by 1 [° C.] and restarting a cooling operation when the detected suction air temperature becomes larger than the preset target value of indoor temperature by 1 [° C.] is conducted by a conventional technique.

In Embodiment 1, fixed values preset in the refrigeration cycle are used as the low pressure target value and the high target value. In case of cooling, the fixed value as the high pressure target value, for example, a temperature of a heat exchanging fluid at an inlet of the outdoor heat exchanger 4, namely a saturation pressure value at a condensation temperature higher than an outdoor temperature by about 10 [° C.]. The outdoor air temperature can be detected by the outdoor temperature detector 24.

Further, in a case that a suction air temperature and a difference between the suction air temperature and an outlet air temperature in the indoor heat exchanger 6 is preset by a user or the like, the outlet air temperature is calculated from: suction air temperature—(difference of suction air temperature from outlet air temperature). An evaporation temperature is determined to be the same value as the outlet air temperature or a result obtained by revising the outlet air temperature so as to be a value smaller than this based on this value. A saturation pressure value at this evaporation temperature is set to be the low pressure target value.

Further, in a case that difference of the suction air temperature from the outlet air temperature is not preset by a user or the like, the pressure difference is assumed to be about 10 through 15 [° C.] to calculate the outlet air temperature, and a saturation pressure at this outlet air temperature is set as the low pressure target value.

Further, in a case that the outlet air temperature and the difference of the suction air temperature from the outlet air temperature in the indoor heat exchanger 6 are preset by a user or the like, the outlet air temperature is set to be a target value of the evaporation temperature and a saturation pressure value at this temperature is set to be the low pressure target value.

Although, in Embodiment 1, the low pressure target value and the high pressure target value are fixed, the target values can be changed to a certain extent in response to a change of the outdoor air even in a running state. This is because the outdoor air temperature is apt to vary. Therefore, in a case that the target values are based on the outdoor air temperature, it is possible to control the refrigeration cycle in proportion to a surrounding environment.

Further, in Embodiment 1, although an example that the number of revolutions of the indoor blower is changed for changing the throughput capacity of the indoor heat exchanger is described, it is also possible to change the throughput capacity by changing the number of passes of a refrigerant passing through the indoor heat exchanger in the refrigeration cycle, changing a heat transfer area, and changing a shape of vanes of the indoor blower.

Further, in a case that a fluid on a user side is a liquid, for example, water, the throughput capacity of the heat exchanger on the user side may be controlled by a capability of a transferring device, such as a pump, for transferring the fluid on the user side.

Further, in case of a heating operation, target values can be preset as described above by inversely applying setting of the low pressure target value and the high pressure target value.

In Embodiment 1, it is possible to promptly draw a proper capability of the refrigeration cycle out by totally controlling the running capacity of the compressor and the throughput capacities of the heat exchanger for evaporation and the heat exchanger for condensation since degrees of change are selected for operating the first operation means 62 for changing the throughput capacity of the heat exchanger for condensation so as to reduce the differences between the high pressure and the low pressure values and the target values in the refrigeration cycle, the second operation means 63 for changing the throughput capacity of the heat exchanger for evaporation, and the running capacity operating means 61 for controlling the running capacity of the compressor 2.

Further, there is an effect that a method of controlling an air conditioner and a control apparatus, by which an amount of energy consumption is small in comparison with a conventional air conditioner since the degrees of change operated by the running capacity operating means 61, the first operation means 62, and the second operation means 63 are selected to minimize a total consumption energy by the compressor 2, the indoor blower 11, and the outdoor blower 10.

Conventionally, the throughput capacity of the outdoor heat exchanger and the running capacity of the compressor were controlled, and the throughput capacity of the indoor heat exchanger was separately controlled. Meanwhile, in Embodiment 1, in addition to the throughput capacity of the outdoor heat exchanger and the running capacity of the compressor, the throughput capacity of the indoor heat exchanger is simultaneously controlled. Therefore, the refrigeration cycle can be synthetically controlled, and it is possible to pursue an energy saving.

In addition to the above-mentioned method of controlling, when the low pressure target value, the high pressure target value, and the difference of the inlet temperature of the heat exchanging fluid from the outlet thereof in the heat exchanger on the user side, namely the difference of the inlet temperature from the outlet temperature are controlled to be involved in the allowable range of target values, for example, by operating the running capacity of the compressor, the throughput capacity of the outdoor heat exchanger, and the throughput capacity of the indoor heat exchanger, it becomes possible to save energy, and a method of controlling a refrigeration cycle capable of properly drawing out its capability is obtainable.

Embodiment 2

Although the high pressure target value Pcm and the low pressure target value Pem are preset fixed values in Embodiment 1, it is possible to further save energy by automatically setting Pcm and Pem in response to a state of indoor air conditioning load or a condition of outdoor air, and properly setting Pcm and Pem by changing in a running state. Further, in Embodiment 2, a difference between an inlet temperature and an outlet temperature of a heat exchanging fluid in the indoor heat exchanger 6, for example, a temperature difference between a suction air and a discharge air of an indoor air, is controlled to be included in an allowable range of a target value determined with respect to such a difference.

An refrigeration cycle of an air conditioner as an air conditioning apparatus is exemplified in Embodiment 2, wherein a control operation in case of cooling will be specifically described.

Figure 7:
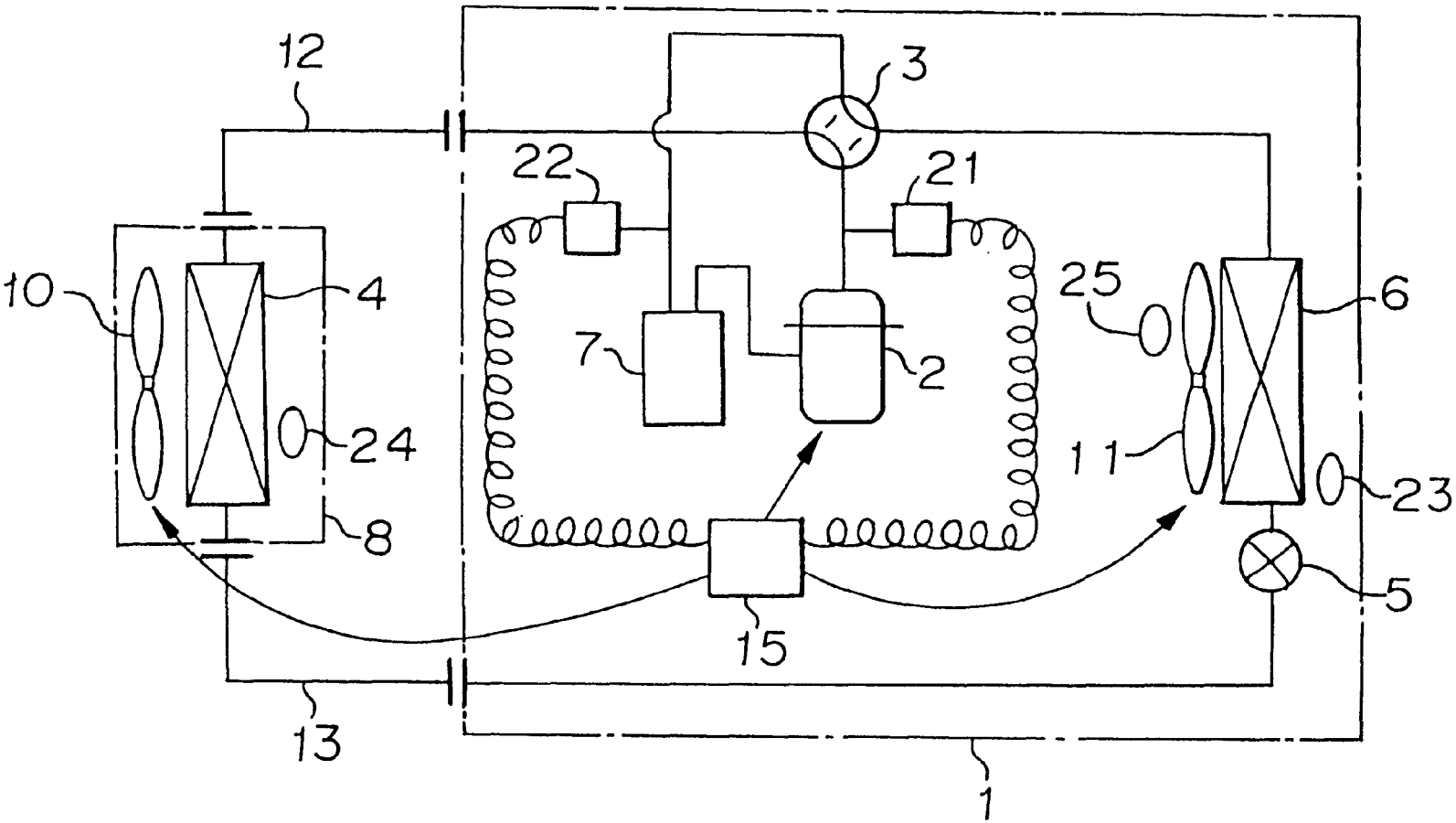
FIG. 7 is a refrigeration circuit diagram for illustrating an air conditioner apparatus according to Embodiment 2 of the present invention.
Figure 8:
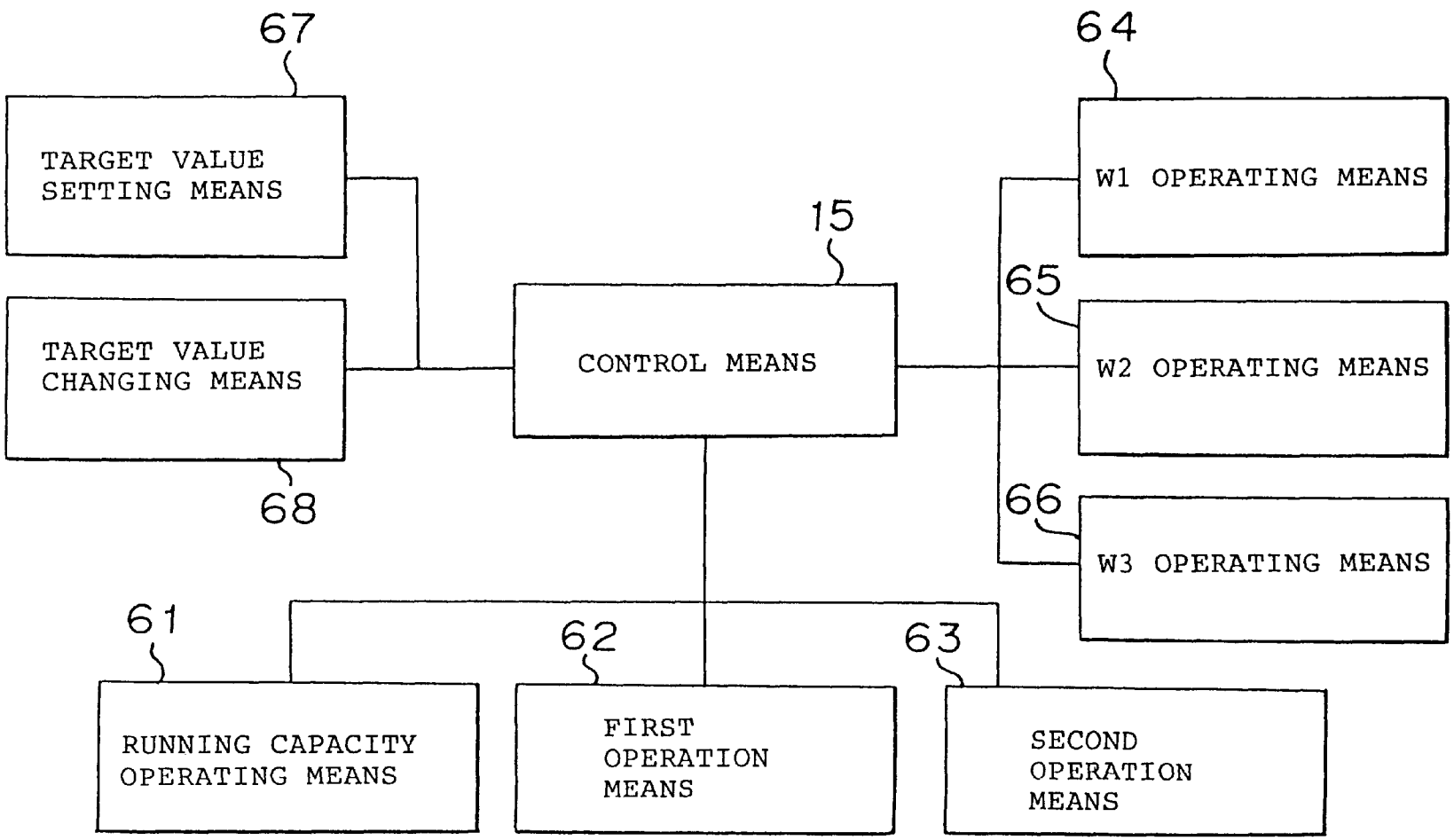
FIG. 8 is a block chart for illustrating a structure of control device of a refrigeration cycle according to Embodiment 2 of the present invention.

FIG. 7 is a circuit diagram of refrigerant constituting an air conditioning apparatus according to Embodiment 2 of the present invention. In FIG. 7, numerical reference 25 designates a temperature detector for detecting an outlet temperature of a heat exchanging fluid, for example, a temperature of discharge air, from an indoor heat exchanger 6. Other numerical references same as those in FIG. 1 designate the same or similar portions. Operations of refrigerant in a cooing operation are similar to those in Embodiment 1. FIG. 8 is a block diagram for illustrating a structure of controlling devices for a cooling cycle according to Embodiment 2. In FIG. 8, numerical reference 66 designates a W3 operating means; numerical reference 67 designates a target value setting means for setting target values of running conditions on a high pressure side and a low pressure side of the cooling cycle; and numerical reference 68 designates a target value changing means for changing the target values in a running state.

Figure 9A:
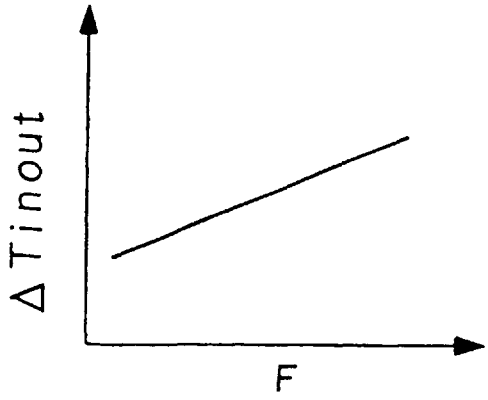
FIG. 9*a* is a graph for illustrating a relationship between the running frequency of compressor F and a temperature difference between suction air and discharge air according to Embodiment 2 of the present invention.
Figure 9B:
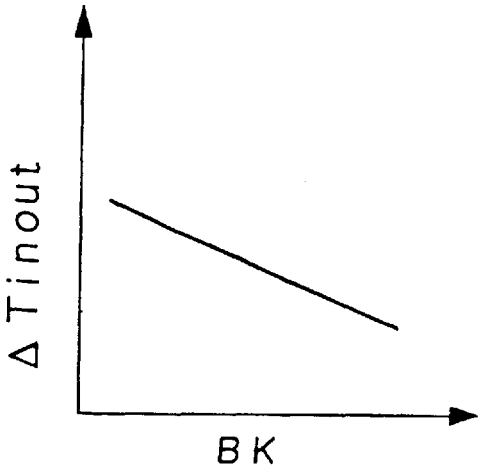
FIG. 9*b* is a graph for illustrating a relationship between the throughput capacity of indoor heat exchanger BK and the temperature difference between the suction air and the discharge air according to Embodiment 2 of the present invention.
Figure 9C:
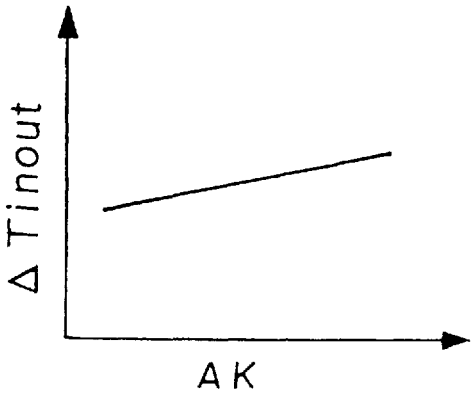
FIG. 9*c* is a graph for illustrating a relationship between the throughput capacity of outdoor heat exchanger AK and the temperature difference between the suction air and the discharge air according to Embodiment 2 of the present invention.

Basic characteristic of the heat exchanger will be explained. Equation 8 represents a degree of change of a temperature difference between a suction air and a discharge air ΔTinout [° C.] of the indoor heat exchanger 6.

$$\Delta(\Delta T\text{inout})=p\cdot\Delta F+q\cdot\Delta BK+r\cdot\Delta AK,$$

where references p, q, and r are quoitents predetermined by tests or calculations in conformity with characteristics of the air conditioner, the characteristics are the number of running frequencies of compressor, a heat exchanging capability, i.e., a throughput capacity of outdoor heat exchanger, a heat exchanging capability, i.e., a throughput capacity of indoor heat exchanger, an outdoor air temperature, an indoor air temperature, a high pressure value (or a condensation temperature), a low pressure value (an evaporation temperature), and so on. FIGS. 9*a* through 9*c* exemplify graphs for illustrating basic characteristics of a heat exchanger, wherein ordinates represent the temperature difference between a suction air and a discharge air ΔTinout [° C.] of the indoor heat exchanger 6; and abscissas respectively represent a running capacity F of the compressor 2, a throughput capacity BK of the indoor heat exchanger 6, and a throughput capacity AK of the indoor heat exchanger 4. The temperature difference ΔTinout [° C.] between a suction air and a discharge air of the indoor heat exchanger 6 can be properly controlled by controlling the running capacity F of the compressor 2, the throughput capacity BK of the indoor heat exchanger 6, and the throughput capacity AK of the outdoor heat exchanger 4 in consideration of these characteristics.

Normally, when an air conditioner is in a cooling operation, a user preset a temperature of a suction air of an indoor unit, or a temperature of a discharge air of the indoor unit and a temperature difference between the suction air and the discharge air. In Embodiment 2, a target value of the evaporation temperature or the low pressure value in the cooling cycle is set to satisfy thus set temperature of the suction air or thus set temperature of the discharge air concerning the temperature of the suction air and the temperature of the discharge air. Further, concerning the inlet temperature of the heat exchanging fluid in the outdoor heat exchanger 4, namely the outdoor air temperature, a target value of the condensation temperature or the high pressure value is set. By automatically setting these target values in conformity with a running condition, the air conditioner is driven and controlled to demonstrate a capability of the cooling cycle.

The preset temperature of the suction air, temperature of the discharge air in the indoor unit, temperature difference between the suction air and the discharge air, and temperature of the discharge air may be manually set by a user or the like or automatically preset.

For example, at a time of cooling, when a dehumidifying quantity is required to increase, the temperature difference between the suction air and the discharge air are increased. On the other hand, when only a temperature is requested to be decreased while maintaining humidity, the temperature difference between the suction air and the discharge air is reduced. By setting the temperature difference between the suction air and the discharge air large, the number of revolutions of a blower in a heat exchanger on a user side is decreased, whereby an evaporation temperature is decreased to facilitate the dehumidification. On the on the hand, by setting the number small, it becomes difficult to dehumidify.

FIG. 10 is a flow chart for illustrating steps of processing a control according to Embodiment 2. At first, by a target value setting means 67, a low pressure target value Pem [Pa] is initialized as a target value representing a running condition on a low pressure side and a high pressure target value Pcm [Pa] is set as a target value representing a running condition on a high pressure side in a step ST11. In the next, a method of setting the low pressure target value will be described.

A target value of the temperature of the discharge air Toutm=Tinm−ΔTinoutm [° C.] is calculated from an air temperature in the indoor unit set and inputted by a user, namely a target value of the temperature of the suction air Tinm [° C.] of the indoor heat exchanger 6 and a target value of the temperature difference between the suction air and the discharge air set and inputted by the user. Thus obtained Toutm is provisionally determined as the evaporation temperature of refrigerant, and a saturation pressure with respect to the evaporation temperature is determined as a low pressure target value Pem [Pa]. When the target value of the temperature difference between the suction air and the discharge air ΔTinoutm [° C.] has not been set by the user, it is set to be, for example, about 10 through 15 [° C.].

On the other hand, a high pressure target value Pcm [Pa] is determined as a condensation temperature obtained by adding about 10 [° C.] to an outdoor air temperature, which is the temperature of sucking the heat exchanging fluid in the heat exchanger for condensing, and a saturation pressure with respect to the condensation temperature is set.

In ST12, preferable values of a manipulated variable ΔFi (i=1–7) of the running capacity of the compressor, a manipulated variable ΔBKij (j=1–3) of the throughput capacity of the indoor heat exchanger 6, and a manipulated variable ΔAKik (k=1–3) of the throughput capacity of the outdoor heat exchanger 4 are selected, and combinations of these manipulated variables are assembled. This process is similar to ST1, ST2, and ST3 in Embodiment 1.

A pressure detected by a pressure detector for high pressure 21 is determined as a high pressure detection value Pc; a pressure detected by a pressure detector for low pressure 22 is determined by a low pressure detection value Pe; and these detection values are input into a control means 15. For all combinations assembled in ST13, ΔPcijk and ΔPeijk are respectively calculated by Equations 1 and 2, and estimated conditions (ΔPcijk, ΔPeijk) are calculated using the high pressure detection value Pc and the low pressure detection value Pe. Further, the temperature of the suction air of the indoor heat exchanger 6 detected by a suction air temperature detector 23 and a discharge air temperature of the indoor heat exchanger 6 detected by a discharge air temperature detector 25 are inputted into the control means 15 to thereby sense the temperature difference between the suction air and the discharge air ΔTinout. Each of the above-mentioned combinations is calculated to obtain Δ(ΔTinout)ijk, and an estimated value of the temperature difference of the discharge air minus the suction air ΔTinoutijk is calculated using the detection value of the temperature difference of the discharge air minus the suction air ΔTinout.

In ST14, an indication W1ijk representing a distance to the target values of high pressure and low pressure is calculated in Equation 6 by a W1 operating means, and simultaneously the amount of consumption power W2ijk of the entire air conditioner is calculated in Equation 7 by a W2 operating means 65. Further, in Embodiment 2, an indication W3ijk representing a distance to the target value of the temperature difference of the discharge air minus the suction air ΔTinout is calculated in Equation 9 by a W3 operating means 66.

$$W3ijk=|\Delta T\text{inout}m-\Delta T\text{inoutijk}|, \quad \text{(Equation 9)}$$

where ΔTinoutm designates a target value of temperature difference of a discharge air minus a suction air.

For each target value, an allowable range having predetermined deviations larger and smaller than the target value including the target value is prepared. The allowable range for the low pressure target value Pem is Pem−0.02 [MPa] ≦=Pe≦Pem+0.02 [MPa], in case of, for example, a cooling operation. The mentioned 0.02 [MPa] corresponds to about 1 [° C.] when converted into an evaporation temperature. The allowable range for the high pressure target value Pcm is Pcm≦Pc≦Pcm+1 [MPa]. The mentioned 1 [MPa] corresponds to about 20 [° C.] when converted into a condensation temperature. The allowable range for the target value of the temperature difference of the discharge air minus the suction air ΔTinoutm is ΔTinoutm−1 [° C.]≦ΔTinout≦ΔTinoutm+1 [° C.]. However, the allowable ranges are not limited to the above-mentioned ranges and may be set in compliance with conditions of using the refrigerating air conditioner in which this refrigeration cycle is assembled.

Further, in case of cooling, because a cooing of an indoor is conducted by evaporation of a refrigerant, an upper limit and a lower limit are predetermined for the allowable range of the low pressure target value; the allowable ranges are set to be narrow; only an upper limit is predetermined for the allowable range of the high pressure target value; and the allowable range of the high pressure target value is set to be wide. In case of heating, because a heating of an indoor is conducted by condensation of the refrigerant, an upper limit and a lower limit are predetermined for the allowable range of the high pressure target value; the allowable range of the high pressure target value is set to be narrow; only a lower limit is predetermined for the allowable range of the low pressure target value; and the allowable range of the low pressure target value is set to be wide.

In ST15, it is judged whether or not the number of the combinations making both of Pcijk and Peijk involved in the allowable ranges is one or less. In case that the number is 1 or less, i.e., 0 or 1, a combination (ΔFi, ΔBKij, ΔAKik) maximizing the indication W1ijk representing distances to the low pressure target value and the high pressure target value is selected. By such a process, the combination (ΔFi, ΔBKij, ΔAKik) having the smallest distances to the high pressure target value and the low pressure target value is selected.

In a case that the number of the combinations allowing Pcijk and Peijk to be included in the allowable ranges is two or more, it is judged whether or not the number of ΔTinoutijk involved in the allowable range among the combinations satisfying the allowable range is 1 or more, in ST17. When the number of ΔTinoutijk satisfying the allowable range is 1 or more, the combinations (ΔFi, ΔBKij, ΔAKik), by which Pcijk and Peijk are involved in the allowable range, ΔTinoutijk is involved in the allowable range, and the minimum value of the amount of consumption power W2ijk is given, is selected in ST18.

In a case that the number of the combinations allowing both of Pcijk and Peijk within the allowable ranges is two or more in ST15 and the number of ΔTinoutijk involved within the allowable range is 0, a combination (ΔFi, ΔBKij, ΔAKik) providing the minimum value indication W3ijk representing the distance to the target value of the temperature difference of the discharge air minus the suction air among the combinations, making both of Pcijk and Peijk involved in the allowable ranges, is selected in ST19.

After selecting the combination (ΔFi, ΔBKij, ΔAKik) being optimum under a given situation in ST16, ST18, and ST19, outputs or controlling F, BK, and AK are generated in ST20.

In ST21, it is judged whether or not the refrigeration cycle is stable. The judgement is based on, for example, the following three conditions:

1) Five minutes or more lapse after starting;

2) A predetermined type lapse after changing the previous low pressure target value Pem, for example, three minutes or more; and 3) A difference between a maximum value and a minimum value of the low pressure detection value Pe is several ° C., for example, within about 1° C. or 2° C. after sampling the low pressure detection value Pe for several minutes, for example, two minutes.

In a case that the refrigeration cycle is not stabilized without satisfying the above three conditions, adaptability of the set target values can not be judged, whereby processing is terminated.

When the refrigeration cycle is judged stable in ST21, adaptability of the low pressure target value Pem is judged by a target value changing means 68. When the adaptability is judged to be negative, the low pressure target value Pem is changed. The adaptability of the low pressure target value Pem is judged based on a relationship between the low pressure detection value Pe under a stable state, a detection value Tin of the suction air temperature detected by the suction air temperature detector 23, and the allowable range of the target value of the suction air temperature and a relationship between a detection value Tout of the discharge air temperature detected by a discharge air temperature detector 25 and the allowable range of the target values of the discharge air temperature. As a result of this judgement, the low pressure target value Pem and a throughput capability BK of the indoor heat exchanger 6 are changed. The allowable range of the target value of the discharge air temperature is within deviations, for example, about ±1° C., larger and smaller than the target value of the suction air temperature Toutm including the target value. The allowable range of the target value of the suction air temperature is within deviations, for example, about ±1° C., larger and smaller than the target value of the suction air temperature Tinm including the target value.

Hereinbelow, judgement of the adaptability of the low pressure target value Pem will be described. Processes of the judgement are different depending on whether or not the low pressure detection value Pem under a stable refrigeration cycle is larger than the allowable range of the low pressure target value Pem, whether or not the low pressure detection value Pe is within the allowable range of the low pressure target value Pem, and whether or not the low pressure detection value Pe is smaller than the allowable range of the low pressure target value Pem.

(A) Case that the refrigeration cycle is stabilized while the low pressure detection value Pem is larger than the allowable range of the low pressure target value Pem.

In such a case, the running capacity of the compressor 2 is supposed to reach a maximum value Fmax [Hz], wherein the judgement is processes as follows;

(1) Increase the throughput capacity BK of the indoor heat exchanger 6 when a detection value of the discharge air temperature Tout of the indoor heat exchanger 6<the target value of the discharge air temperature Toutm of the indoor heat exchanger 6, because it is supposed that the amount of air flow of the indoor blower 11 is excessively choked;

(2) Increase the low pressure target value Pem based on a judgement that the low pressure target value Pem is small when a detection value of the suction air temperature Tin of the indoor heat exchanger 6<a target value of the suction air temperature Tinm of the indoor heat exchanger 6, because the capability is excessive and the capacity of the compressor 2 is required to decrease;

(3) Increase the low pressure target value Pem when both of the detection value of the suction air temperature and the detection value of the discharge air temperature Tout of the indoor heat exchanger 6 are within the allowable ranges, because the running condition is appropriate but the low pressure target value is small; and (4) Remain the low pressure target value Pem the same, when (1) through (3) are not applicable because it is supposed to be in an overload.

(B) Case that the refrigeration cycle is stabilized while the low pressure detection value Pe is involved within the allowable range of the low pressure target value Pem, the judgement is processed as follows:

(1) Increase the throughput capacity BK of the indoor heat exchanger 6 when the detection value of the discharge air temperature Tout of the indoor heat exchanger 6<the target value of the discharge air temperature Toutm of the indoor heat exchanger 6, because it is supposed that an air flow of the indoor blower 11 is excessively choked;

(2) Decrease the low pressure target value Pem by judging that the low pressure target value Pem is large when the detection value of the suction air temperature Tin of the indoor heat exchanger 6≧the target value of the suction air temperature Tinm of the indoor heat exchanger 6, because the capability is insufficient and the capacity of the compressor 2 is required to increase;

(3) Increase the low pressure target value Pem by judging that the low pressure target value Pem is low when the detection value of the suction air temperature Tin of the indoor heat exchanger 6<the target value of the suction air temperature Tinm of the indoor heat exchanger 6, because the capability is excessive and the capacity of the compressor 2 is required to decrease;

(4) Decrease the low pressure target value Pem when the detection value of the suction air temperature Tin of the indoor heat exchanger 6 remains within the allowable range and the detection value of the discharge air temperature Tout>the detection value of the discharge air temperature Toutm, because the throughput capacity of the indoor heat exchanger 6, i.e., the air flow, is required to decrease while maintaining the capability; and (5) Judge the low pressure target value Pem appropriate when both of the detection value of the suction air temperature Tin and the detection value of the discharge air temperature Tout of the indoor heat exchanger 6 is involved within the allowable ranges.

(C) Case that the refrigeration cycle is stabilized while the low pressure detection value Pe is lower than the allowable range of the low pressure target value Pem The case is supposed that the running capacity of the compressor 2 reaches a minimum value Fmin [Hz], wherein the judgment is processed as follows;

(1) Increase the throughput capacity BK of the indoor heat exchanger 6 when the detection value of the discharge air temperature Tout of the indoor heat exchanger 6<the target value of the discharge air temperature Toutm of the indoor heat exchanger 6, because an air flow of the indoor blower 11 is excessively choked;

(2) Decrease the low pressure target value Pem by judging that the low pressure target value Pem is high when the detection value of the suction air temperature Tin of the indoor heat exchanger 6>the target value of the suction air temperature Tinm of the indoor heat exchanger 6, because the capability is insufficient and the capacity of the compressor 2 is required to increase;

(3) Decrease the low pressure target value Pem when both of the detection value of the suction air temperature Tin and the detection value of the discharge air temperature Tout of the indoor heat exchanger 6 is involved within the allowable range because the running condition is appropriate but the low pressure target value Pem is high;

(4) Decrease the low pressure target value Pem when the detection value of the suction air temperature Tin of the indoor heat exchanger 6 is involved within the allowable range and the detection value of the discharge air temperature Tout>the target value of the discharge air temperature Toutm, because the throughput capacity of the indoor heat exchanger 6, i.e., the air flow is required to decrease while maintaining the capability; and (5) Remain the low pressure target value Pem the same when the above (1)–(4) are not applicable, because it is supposed that a load is excessively small.

The low pressure target value Pem is changed in accordance with (A), (B), or (C), wherein this process is completed.

The low pressure Pe is a saturation pressure of the evaporation temperature Te. Therefore, changing the low pressure target value Pe is same as changing a target value of the evaporation temperature Tem. Hereinbelow, a method of changing the evaporation temperature target value Tem will be descried in detail.

Figure 11:
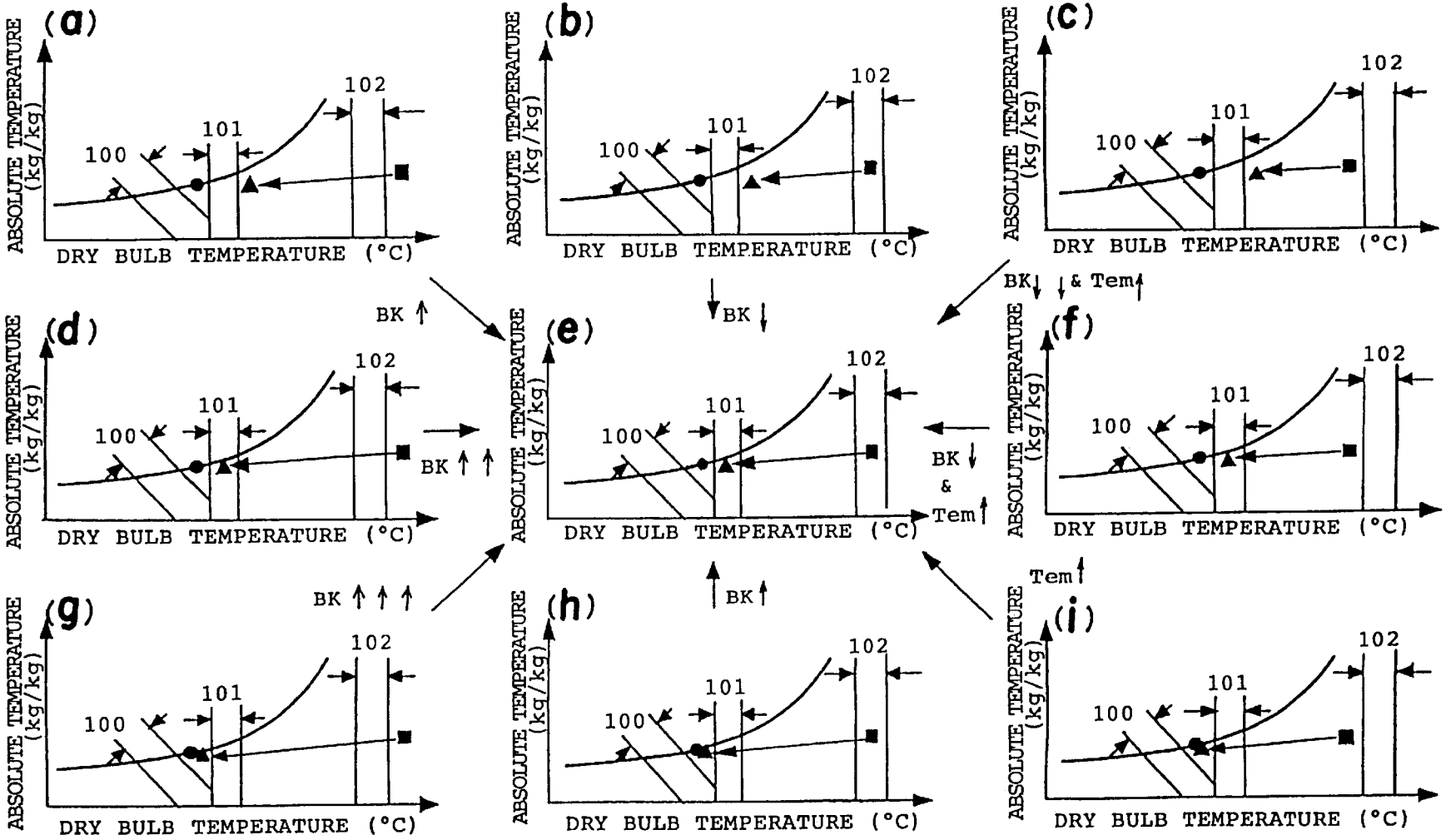
FIGS. 11*a*–11*i* are diagrams for explaining transitions of a low-pressure target value according to Embodiment 2 of the present invention.

FIG. 11 illustrates changes of the target value of evaporation temperature Tem in the above case (A), in other words, a case that the refrigeration cycle is stabilized while the evaporation temperature rests on a point larger than the allowable range of the target value of evaporation temperature Tem, wherein references (*a*) through (*i*) respectively show a relationship among the evaporation temperature, the suction air temperature, and the discharge air temperature in psychrometric chart. In FIG. 11, ordinates represent a dry-bulb temperature [° C.] and abscissas represent an absolute temperature [(moisture) kg/(air) kg]. In FIG. 11, numerical reference 100 designates an allowable range of evaporation temperature; numerical reference 101 designates an allowable range of discharge air temperature; and numerical reference 102 designates an allowable range of suction air temperature.

The allowable range of evaporation temperature is used instead of the allowable range of the low pressure target value, wherein a curve is a saturation curve of humidity of 100%; a mark of black circle designates the detected value Te of the evaporation temperature, i.e., the low pressure target value; a mark of black triangle designates the detected value of the discharge air temperature Tout; and a mark of black square designates the detected value of the suction air temperature Tin. Further, in FIG. 11, reference Tem↑ means that the target value of evaporation temperature is increased; reference BK↓ means that the throughput capacity of the indoor heat exchanger 6 is decreased; and references ↑ ↑ and ↓ ↓ respectively mean that the degree of change is increased. For example, when the throughput capacity BK of the indoor heat exchanger 6 is increased in a case that the discharge air temperature Tout, the evaporation temperature Te, and the suction air temperature Tin are all larger than the allowable ranges as in FIG. 11(*a*), the relationship is changed to that illustrated in FIG. 11(*e*), the evaporation temperature Te is larger than the allowable range and the discharge air temperature Tout and the suction air temperature Tin is involved within the allowable ranges. The target value of evaporation temperature Tem as the low pressure target value is changed from (*a*) through (*d*) and (*f*) through (*i*) to (*e*). Further, the target value of evaporation temperature Tem is changed from FIG. 11(*e*) so that the evaporation temperature Te is involved in the allowable range of evaporation temperature.

Figure 12:
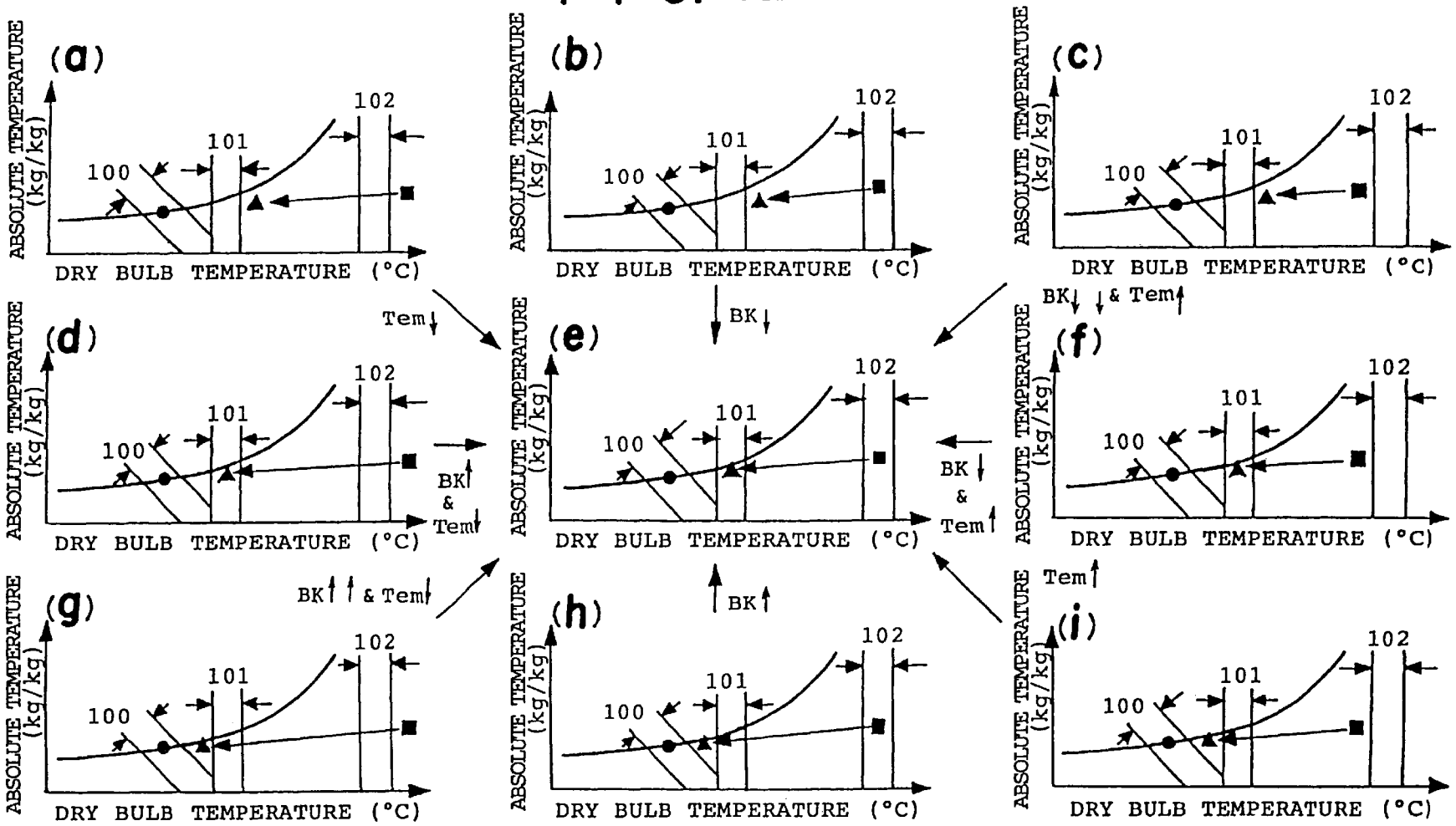
FIGS. 12*a*–12*i* are diagrams for explaining transitions of the low-pressure target value according to Embodiment 2 of the present invention.

FIG. 12 is graphs for illustrating changes of the target value of evaporation temperature Tem in a case corresponding the above (B), in other words, a case that the refrigeration cycle is stabilized while the evaporation temperature Te remains within the allowable range of the target value of evaporation temperature Tem, wherein (*a*) through (*i*) illustrate a relationship among the evaporation temperature, the suction air temperature, and the discharge air temperature in a psychrometric chart, wherein numerical reference 100 designates an allowable range of evaporation temperature; numerical reference 101 designates an allowable range of discharge air temperature; and numerical reference 102 designates an allowable range of suction air temperature.

For example, when the target value of evaporation temperature Tem is decreased when the discharge air temperature Tout and the suction air temperature tin are larger than the allowable ranges and the evaporation temperature Te is involved in the allowable range as in FIG. 12(*a*), the relationship changes to (*e*). In FIG. 12(*e*), all of the discharge air temperature Tout, the evaporation temperature Te, and the suction air temperature Tin is involved in the allowable ranges. If the air conditioner is run under such a condition, it is possible to judge that the low pressure target value is appropriate.

Figure 13:
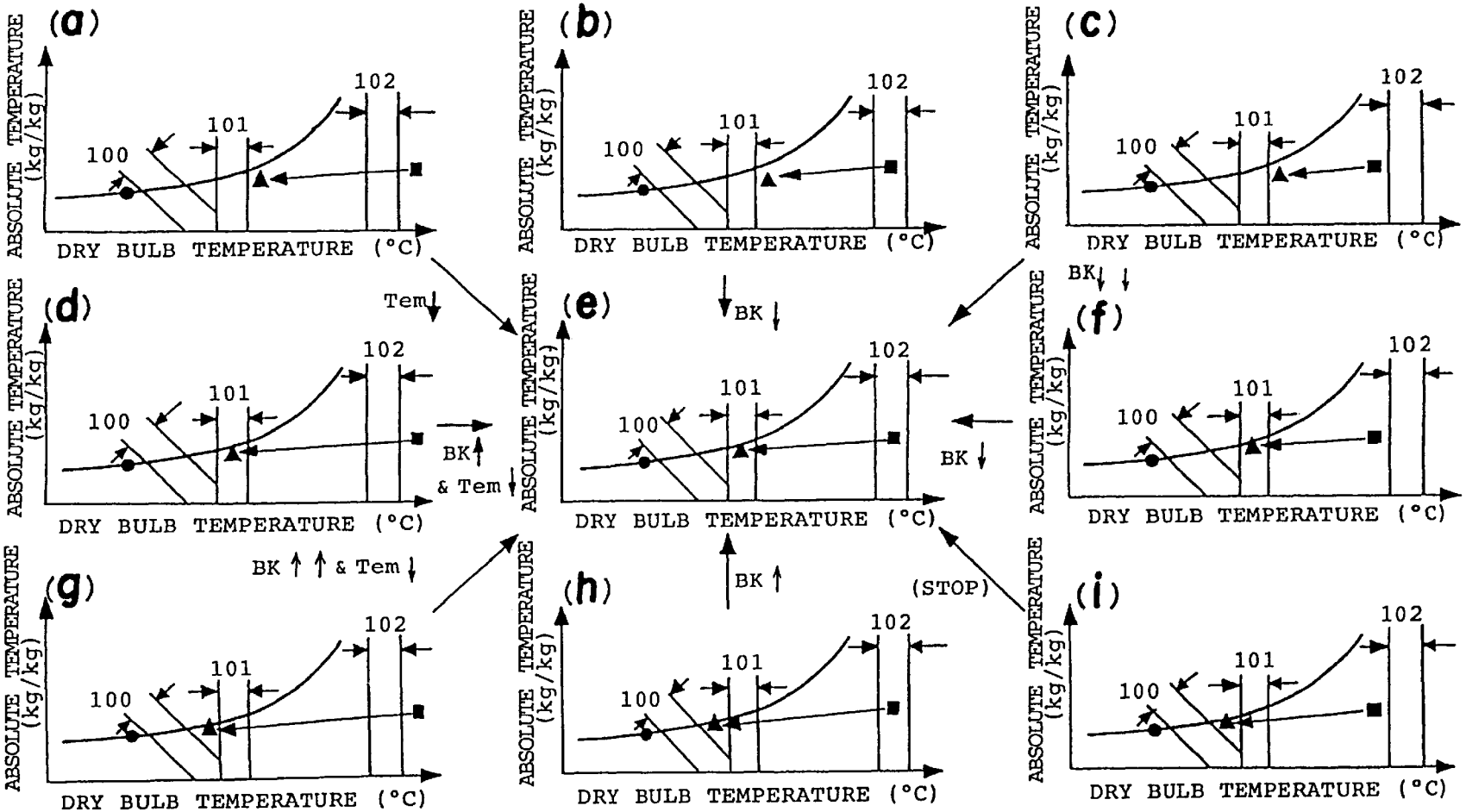
FIGS. 13*a*–13*i* are diagrams for explaining transitions of the low-pressure target value according to Embodiment 2 of the present invention.
Figure 14:
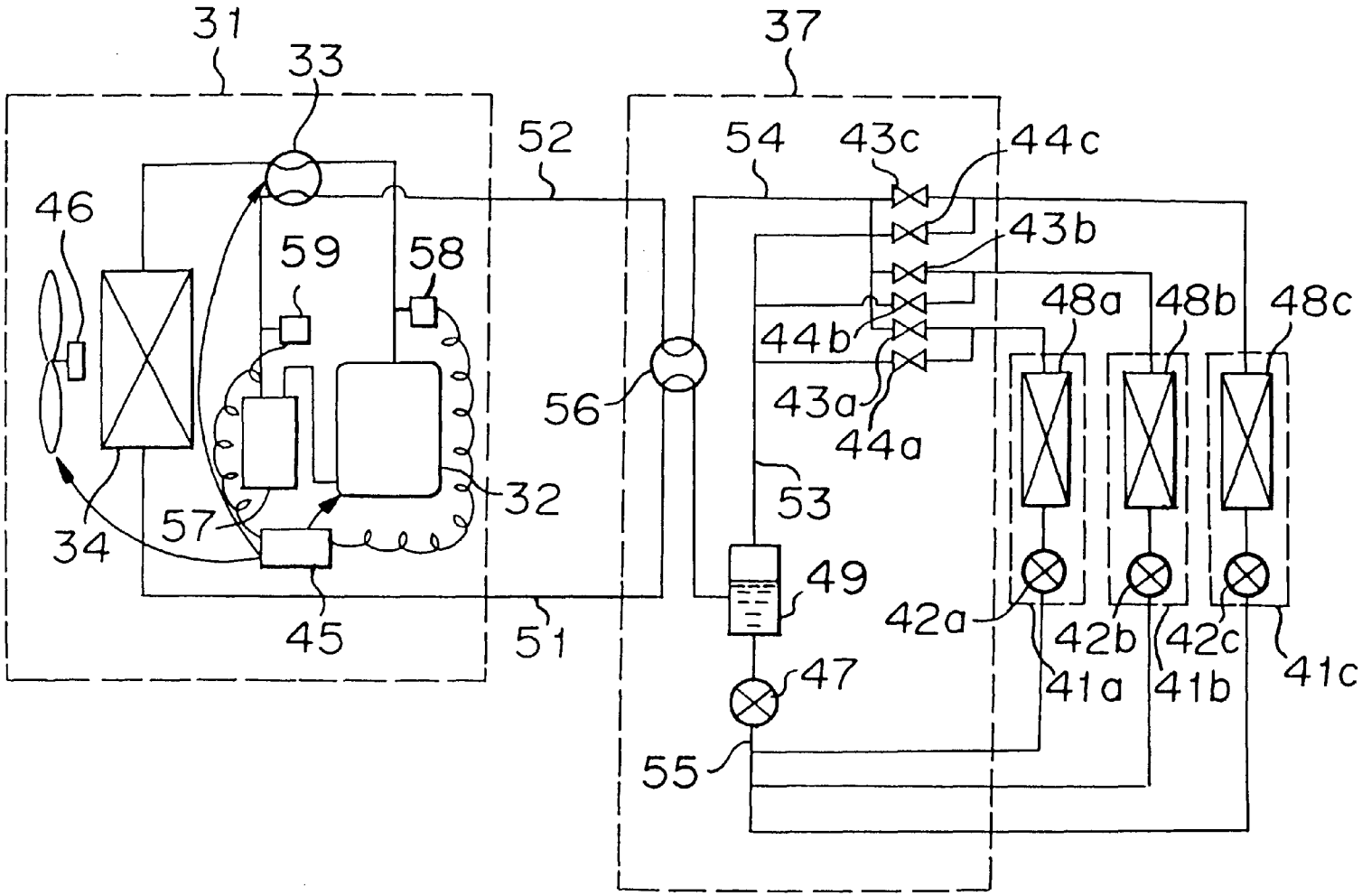
FIG. 14 is a refrigeration circuit diagram for illustrating a conventional multi-chamber type air conditioner.

FIG. 13 is graphs for illustrating changes of the target value of evaporation temperature Tem in a case corresponding to the above (C), in other words, changes of the target value of evaporation temperature Tem while the evaporation temperature Te is lower than the allowable range of the target value of evaporation temperature Tem. As illustrated in FIGS. 11 and 12, (*a*) through (*f*) illustrate a relationship between the evaporation temperature, the suction air temperature, and the discharge air temperature in a psychrometric chart and numerical reference 100 designates an allowable range of evaporation temperature; numerical reference 101 designates an allowable range of discharge air temperature; and numerical reference 102 designates an allowable range of suction air temperature.

For example, when the target value of evaporation temperature Tem is decreased in a case that the evaporation temperature Te is smaller than the allowable range and the discharge air temperature Tout and the suction air temperature Tin are larger than the allowable ranges as in FIG. 13(*a*), the relationship changes to (*e*). In FIG. 13(*e*), the evaporation temperature Te is smaller than the allowable range, and the discharge air temperature Tout and the suction air temperature Tin is involved in the allowable ranges. The target value of evaporation temperature Tem as the low pressure target value is changed from FIGS. 13(*a*) through (*b*) and (*f*) through (*i*) to (*e*). Further, the target value of evaporation temperature Tem is changed from FIG. 13(*e*) so that the evaporation temperature Te moves into the allowable range of evaporation temperature.

By repeatedly executing controlling processes of ST11 through ST22 for a predetermined time intervals, for example, intervals of twenty seconds, adaptability of the target values are also repeatedly judged, whereby the saturation temperature Tem [° C.] for the low pressure target value Pem can be set with respect to the indoor air temperature Tinm [° C.], manually or automatically preset by a user and so on, and further it is possible to automatically fix the low pressure target value Pem so as to save energy.

Although the degrees of change of the above low pressure target value Pem, in other words, the amount of increase and the amount of decrease of the low pressure target value Pem, is not mentioned above, it is sufficient to set to be, for example, a range corresponding to an evaporation temperature of about 1° C., i.e., about 0.02 [MPa].

Further, by predetermining the degrees of change of the low pressure target value Pem so that degree of increment>degree of decrement, the low pressure target value having a relatively large value converges into an appropriate value, whereby energy can be saved. For example, the degree of increment of the low pressure target value Pem is set to be 0.02 MPa corresponding to an evaporation temperature of 1° C., and the degree of decrement of the low pressure target value Pem is set to be 0.01 MPa corresponding to an evaporation temperature of 0.5° C.

Because thus fixed low pressure target value Pem is supposed to remain the same as long as a preset value of indoor room temperature is not changed in a case that a condition on a heat source side, i.e., a change of the outdoor air temperature, is not excessively large, it is possible to quickly demonstrate a proper capability when an indoor air temperature same as a previously set temperature by memorizing previous low pressure target values Pem respectively fixed in correspondence with setting values of the indoor room temperature in the control means 15. It is possible to further quickly demonstrate the proper capability by memorizing thus fixed low pressure target values Pem based on conditions on a heat source side and a user side and setting one of the low pressure target values Pem corresponding to conditions closest to conditions on a heat source side and a user side at a time of starting a next operation.

In case of cooling as described, the adaptability of the low pressure target value Pem is judged by a difference between an inlet temperature of the heat exchanging fluid and an allowable range of inlet temperature of the indoor heat exchanger 6 and a difference between an outlet temperature of the heat exchanging fluid and an allowable range of outlet temperature of the indoor heat exchanger 6, to be thereby adjusted. In case of heating, a similar function is obtainable by judging a difference between an inlet temperature of the heat exchanging fluid and an allowable range of inlet temperature of the heat exchanger 6 and a difference between an outlet temperature of the heat exchanging fluid and an allowable range of outlet temperature of the indoor heat exchanger 6 so that adaptability of the high pressure target value Pcm is succeedingly adjusted.

In Embodiment 2, the control means 15, the target value setting means 67, the target value changing means 68, the W1 operating means 64, the W2 operating means 65, and the W3 operating means 66 are included in a processing unit of a microcomputer and so on. Such a microcomputer is installed in, for example, a box accommodating electric apparatuses.

As described, in Embodiment 2, it is possible to run the refrigeration cycle so as to demonstrate the proper capability in response to a demand of a user and a condition of load because the high pressure target value and the low pressure target value are automatically set with respect to the preset suction air temperature of the indoor heat exchanger 6 and the outdoor air temperature. Further, there is an effect that the refrigerating air conditioner consuming a smaller quantity of energy in comparison with a case that only the running capacity of the compressor and the throughput capacity of the outdoor heat exchanger are controlled to make the high pressure detection value and the low pressure detection value to respectively converge into the high pressure target value and the low pressure target value while advancely fixing the low pressure target value to be a constant value as in the conventional technique since the degrees of change in operating the running capacity of the compressor, the throughput capacity of the indoor heat exchanger, and the throughput capacity of the outdoor heat exchanger are selected to reduce energy consumption of the sum of the compressor, the indoor blower, and the outdoor blower.

Further, it is possible to operate the refrigeration cycle in response to conditions of load such as a circumstance in using and a convenience of a user, because it is operated to properly demonstrate a capability and save energy since the preset target values of the running condition of the refrigeration cycle are appropriately changed during the operation.

Further, it is possible to properly select the degrees of change of the capacity of the compressor 2, and throughput capacities of the heat exchangers for condensing and evaporating 4 and 6 and quickly demonstrate the capability of the refrigeration cycle by setting the degrees of change as described in Embodiment 2. Further, it is possible to calculate in a short time to select appropriate combinations since the combination of the degrees of change achieving a target of the running condition and minimizing the power consumption among a plurality of degrees of change determined based on standard degrees of change, which can be a target value of the running condition of the refrigeration cycle.

Further, the plurality of degrees of change $\Delta F$ , $\Delta BK$, and $\Delta AK$, to which the low pressure target value or the high pressure target value approaches, are obtainable by inversely calculate $\Delta Pc$ as a difference between the high pressure detection value and the high pressure target value, $\Delta Pe$ as a difference between the low pressure detection value and low pressure target value, and $\Delta(\Delta Tinout)$ as a difference between the detection value of the temperature difference of the suction air minus the discharge air and the target value of the temperature difference of the suction air minus the discharge air, based on Equations 1, 2, and 8. Thus obtained degrees of change are used as the standard degrees of change, and the plurality of degrees of change are respectively obtained based on the standard degrees of change. For example, by defining $\Delta Fn$, $\Delta BKn$, and $\Delta AKn$, respectively as the standard degree of change, to which the high pressure target value approaches, the degrees of change of the running capacity of the compressor 2 are set as $|\Delta Fn|$, 0, $-|\Delta Fn|$; the degrees of change of the throughput capacity of the indoor heat exchanger 6 are set as $|\Delta BKn|$, 0, $-|\Delta BKn|$; and the degrees of change of the throughput capacity of the outdoor heat exchanger 4 are set as $|\Delta AKn|$, 0, $-|\Delta AKn|$. Further, combinations as much as 27 groups of these preferable degrees change may be made.

Needless to say that even when these combinations are made, it is necessary that the degrees of change $\Delta Fn$ should be involved within a controllable range of the running capacity of the compressor 2 and the degrees of change $\Delta BKn$ and $\Delta AKn$ should be involved within a controllable range of the throughput capacity of the indoor heat exchanger 6.

Embodiment 3

Although, in Embodiment 2, the method of setting the target in the case of presetting the target value of the suction air temperature Tinm into the indoor heat exchanger 6 and the target value of the temperature difference of the suction air minus the discharge air $\Delta Tinoutm$ by a user or the like is described, it is also possible to automatically set the low pressure target value Pem in a similar manner thereto even in a case that a target value of temperature Toutm of a discharge air sent from the indoor heat exchanger 6 to an indoor by an indoor blower 11 and the target value of the temperature difference of the suction air minus the discharge air ΔTinoutm are previously set by a user.

In this case, when the preset target value of the discharge air temperature is defined as Toutm [° C.], a low pressure target value Pem is set as follows. A target value of evaporation temperature is set to be the target value of the discharge air temperature Toutm [° C.], and a saturation pressure corresponding to the target value of evaporation temperature Tem [° C.] is set as an initial value of the low pressure target value Pem. Thereafter, the target value Pem for saving energy is fixed by judging adaptability similarly to Embodiment 2. Further, the target value of the suction air temperature Tinm used for judging the adaptability of the low pressure target value Pem can be calculated from the target value of the discharge air temperature and the target value of the temperature difference of the suction air minus the discharge air.

Further, in a case that a user does not set the target value of the temperature difference of the suction air minus the discharge air, it is possible to calculate the target value of the temperature difference of the suction air minus the discharge air as, for example, 10 through 15 [° C.] in consideration of a property of heat exchanger.

As described, in Embodiment 3, since the low pressure target value can be properly and automatically set in correspondence with a value, set by a user, of the discharge air temperature sent from the indoor heat exchanger 6 to the indoor by the indoor blower 10, it is possible to properly set the low pressure target value in response to conditions of load. Therefore, in comparison with the case that the low pressure target value is previously fixed to have a predetermined value so as to be applicable to a large load, there is an effect that the control apparatus of the refrigeration cycle and the method of controlling the refrigeration cycle, by which energy consumption is reduced, is obtainable.

In Embodiments 1 thorough 3, for the first and second operation means 62 and 63 for operating the heat exchanging capability, i.e., the throughput capacity of the heat exchangers 4 and 6, it is possible to use operating the number of revolutions of the blowers 10 and 11 for the heat exchangers 4 and 6, a control means for changing the number of blowers 10 and 11 to be operated in a case that a plurality of blowers are equipped in the blowers 10 and 11, a control means for changing angles of fans in a case that the blowers have variable-pitch fans, and a control means for changing directions of fans, and a control means for operating the blowers. Further, for a means for operating the heat exchangers 4 and 6, it is possible to use a means of controlling paths of refrigeration flow route in the heat exchangers 4 and 6, for example, valves provided in the heat exchangers 4 and 6, a means for controlling heat transferring area of the heat exchangers 4 and 6, for example, valves and so on.

In Embodiments 1 through 3, for the means 61 for controlling the running capacity of the compressor 2, it is possible to use a means for controlling a frequency of the compressor 2, a means for controlling the number of cylinders of the compressor in a case that the compressor has a plurality of cylinders, a means of controlling the number of compressing parts in a case that the compressor has a plurality of compressing parts such as a scroll compressor, a means of controlling the quantity of refrigerant to be sucked by providing a choke on a side of suction of the compressor, a means of controlling the number of refrigerant to be circulated by bypassing a part of refrigerant discharged from the compressor on the suction side, and so on. In this, it is necessary to change the quoitents of Equation 7 for calculating power consumption in consideration of the running capacity operating means and the first and second operation means 62 and 63.

Further, although, in Embodiments 1 through 3, the running condition of the refrigeration cycle is controlled to be the target values set as the high pressure set value and the low pressure set value, it is also possible to set the target values as the condensation temperature and evaporation temperature of the refrigerant representing the running conditions of the refrigeration cycle. In other words, it is possible to constitute the refrigeration cycle so that the running conditions of the refrigeration cycle are involved in an allowable range of target value on a high pressure side set as the allowable range of the target value of the condensation temperature and an allowable range of target value on a low pressure side set as the allowable range of the target value of evaporation temperature.

The detection value of the condensation temperature can be obtained by converting the high pressure detection value detected by the pressure detector for high pressure 21 into a condensation temperature or detecting a condensation temperature using a temperature detector installed in the heat exchanger for condensation. When the pressure detection value is converted into a temperature, it is preferable that a saturation vapor temperature and a saturation liquid temperature are calculated from the detection value of high pressure detected by the pressure detector for high pressure 21 and a condensation temperature is determined using an average value of the saturation vapor temperature and the saturation liquid temperature because in a case that a refrigerant for operating the refrigeration cycle is not an azeotropic refrigerant, it has a property that a temperature is decreased at a time of condensing under a constant pressure. Similarly, the detection value of evaporation temperature may be obtained by converting the low pressure detection value detected by the pressure detector for low pressure 22 into an evaporation temperature or detect an evaporation temperature using a temperature detector installed in the heat exchanger for evaporation. In a case that the detection value of pressure is converted into a temperature, it is preferable that a saturation vapor temperature and a saturation liquid temperature are calculated from a detection value of low pressure detected by the detector for low pressure 22 and obtaining an evaporation temperature using an average value of the saturation vapor temperature and the saturation liquid temperature because in a case that a refrigerant circulating according to the refrigeration cycle is not an azeotropic refrigerant, it has a property that a temperature is increased in evaporating under a constant pressure. In comparison with a pressure detector, a temperature detector costs low. Therefore, an entire refrigerating air conditioner costs low using the temperature detector instead of the pressure detector.

Although, in Embodiments 1 through 3 the control apparatus and a method of controlling a cooling operation of the air conditioner are described, it is possible to apply the control apparatus and the method of controlling to a heating operation. In case of the cooing operation, the upper limit and the lower limit of the allowable range of the target value on the low pressure side are set, only the lower limit of the allowable range of the target value is set on the high pressure side, and it is controlled to bring the detected value to the target values in running the refrigeration cycle giving a weight on the target value on the low pressure side. On the contrary, in case of the heating operation, only an upper limit of the allowable range of the target value on the low pressure side is set and an upper limit and a lower limit of the allowable range of the target value on the high pressure side are set to control a detected value so as to converge the target value, giving a weight on the high pressure target value. In judging the proper target value, the target value on the low pressure side is judged and properly changed in the cooling operation, and the target value on the high pressure side is judged and properly changed in the heating operation, whereby it is possible to demonstrate the capability in response to the conditions of load and save energy. Incidentally, the air conditioner shown in FIGS. 1 and 2 has dual functions of cooling and heating by switching the four-way valve 3.

Furthermore, the present invention is applicable to an apparatus for controlling and a method of controlling a vapor cycle refrigeration system utilized for a domestic air conditioner and a refrigerating air conditioner such as an air conditioner for an electronic equipment, a refrigerator for a low temperature, and a cold storage room.

Although, in Embodiments 2 and 3, an example that the low pressure target P is properly changed after comparing the detection value of the suction air temperature or the discharge air temperature of the indoor heat exchanger with its target value is explained, it is more preferable to change the low pressure target value Pem after comparing a predicted value of the suction air temperature or the discharge air temperature with its target value after several dozens of seconds through several minutes. In such a case, it is possible to further stably bring the suction air temperature or the discharge air temperature to the target value in consideration of a property that the indoor air temperature varies with a delay when the capability of the refrigeration cycle is changed, whereby comfortability and a temperature stability of an indoor space are improved. As for a prediction in such a case, for example, a prediction of the suction air temperature, a tripartite prediction for predicting a suction air temperature after a period of $\tau$ from detected values of suction air temperature at present and two past points before the period of $\tau$ and two times of the period $\tau$ may be used, where the detected values of suction air temperature are detected by intervals of $\tau$. Further, by respectively substituting a value before two times of the period $\tau$ for the value before the period $\tau$, the period before the period $\tau$ for the value at present, the present value for the predicted value after the period $\tau$, it is possible to predict a value after two times of the period $\tau$. It is also possible to use a linear interpolation method, an ARIMA model, a chaos theory, a neural network, or the like can be used for such a prediction.

Further, although in Embodiments 2 and 3, the saturation pressure corresponding to the evaporation temperature of the refrigerant, which is the target value Toutm [° C.] of the discharge air temperature, is used as the initial value of the low pressure target value Pem, a saturation pressure corresponding a product of the target value Toutm [° C.] of the discharge air temperature and a constant less than 1 may be used as the initial value of the low pressure target value Pem. The suction air temperature or the discharge air temperature converges into the target value within a less time.

Further, although in Embodiments 2 and 3, the target value of the temperature difference of the suction air minus the discharge air ΔTinoutm is constant, the target value may be changed in response to a deviation of the suction air temperature Tin or the discharge air temperature Tout from its target value. In other words, when Tin>>Tinm at just after starting the cooling and the throughput capacity of the indoor heat exchanger is required to increase, ΔTinoutm is set to be a relatively small value. On the contrary, when Tin≈Tinm at just after cooling to a certain extent, ΔTinoutm is set to be a relatively large value to obtain a requisite capability of dehumidifying. When cooling OA equipments and so on requiring less dehumidifying, it is preferable that ΔTinoutm is set to be relatively large. When it is required to intensively dehumidify for making people feel sufficient comfortability, it is preferable to set ΔTinoutm relatively small. As described, by properly changing the setting of ΔTinoutm, control of an air condition becomes possible in conformity with a purpose of usage of an air conditioning room and a desired career of conditions of air, for example, which career is only reducing a temperature; dehumidifying after reducing a temperature; or reducing a temperature after dehumidifying.

Embodiment 4

Although, in Embodiments 2 and 3, the low pressure target value Pem is changed by comparing the detection values and target values of the suction air temperature and the discharge air temperature for bringing the temperature difference of the discharge air temperature minus the suction air temperature ΔTinout closer to the target value ΔTinoutm, a method of changing a low pressure target value Pem using a suction air temperature or a discharge air temperature will be described for a case that ΔTinoutm is not preset or has less significance.

Examples that only the suction air temperature is set or both of the suction air temperature and the temperature difference of the suction air minus the discharge air are set but it is not important to bring the temperature difference of the discharge air minus the suction air closer to a preset value will be described. In FIG. 10, when a refrigeration cycle is judged to be stable, adaptability of the low pressure target value Pem is judged and changed in case of need in ST22.

(A) Case that the refrigeration cycle is stabilized while the low pressure detection value Pem is larger than the allowable range of low pressure target value Pem.

It is supposed that a running capacity of a compressor 2 reaches a maximum value Fmax [Hz] in this case, wherein processes are as follows:

(1) Substitute a low pressure detection value Pe at present for the low pressure target value Pem by judging that the low pressure target value is low when a detection value of suction air temperature Tin of an indoor heat exchanger 6<a target value of suction air temperature Tinm of the indoor heat exchanger 6 minus $\alpha$1 ($\alpha$1≧0);

(2) Change the low pressure target value Pem in response to the magnitude of Tin−Tinm when the detection value of suction air temperature Tin of the indoor heat exchanger 6≧the target value of suction air temperature Tinm of the indoor heat exchanger 6−$\alpha$1 ($\alpha$1≧0). For example, provided that a new Pem=an old Pem−$\gamma$·(Tin−Tinm) ($\gamma$>0), a capability is suppressed by increasing Pem in case of Tin<Tinm, and the capability is increased by reducing Pem in case of Tin≧Tinm.

(B) Case that the refrigeration cycle is stabilized while the low pressure detection value Pe is involved in the allowable range of low pressure target value Pem (1) Change the low pressure target value Pem in response to the magnitude of Tin−Tinm. For example, provided that a new Pem=an old Pem−$\gamma$·(Tin−Tinm) ($\gamma$>0), the capability is suppressed by increasing Pem in case of Tin<Tinm, and the capability is increased by reducing Pem in case of Tin≧Tinm.

(C) Case that the refrigeration cycle is stabilized while the low pressure detection value Pe is lower than the allowable range of low pressure target value Pem It is supposed that the running capacity of the compressor 2 reaches a minimum value Fmin [Hz], wherein processes are as follows:

(1) Change the low pressure target value Pem in response to the magnitude of Tin−Tinm when the detection value of suction air temperature Tin of the indoor heat exchanger 6≧the target value of suction air temperature Tinm of the indoor heat exchanger 6+α2 (α2≧0). For example, provided that a new Pem=an old Pem−γ·(Tin−Tinm) (γ>0), the capability is suppressed by increasing Pem in case of Tin<Tinm, and the capability is increased by reducing Pem in case of Tin≧Tinm; and (2) Substitute a low pressure detection value Pe at present for the low pressure target value Pem by judging that the low pressure target value is low when the detection value of suction air temperature Tin of the indoor heat exchanger 6>the target value of suction air temperature Tinm of the indoor heat exchanger 6+α2 (α2≧0).

The low pressure target value Pem is changed in accordance with the above (A), (B), and (C), whereby the controlling processes are finished. With respect to thus newly changed low pressure target value Pem, an apparatus for controlling of a refrigeration cycle according to the present invention calculates, for example, combinations of manipulated variables (ΔFi, ΔBKij, ΔAKik) in a similar manner to Embodiment 1, and ST4 through ST8 in FIG. 5 are processed. At this time, in case that the suction air temperature is higher than the target value to a certain extent, i.e., Tin>Tinm+α3 (α3>0: e.g. α3=2), because it is presumed that the refrigeration cycle has not a sufficient capability or is in a middle of cooling, only an operation of increasing a throughput capacity of indoor heat exchanger BK [W/° C.] is admitted. In this case, for example, when W1ijk calculated by Equation 6 in ST5 is multiplied by 0 using ik satisfying ΔBKik=0· or ΔBKik<0, it is evaluated that a distance to a target point is long, whereby combinations of the manipulated variables (ΔFi, ΔBKij, ΔAKik) are finally selected among combinations of the manipulated variables satisfying ΔBK>0, namely which are to increase the throughput capacity of indoor heat exchanger.

On the other hand, in a case that the suction air temperature is lower than the target value to a certain extent, namely Tin<Tinm−α4 (α4>0: e.g. α4=2), it is presumed that the refrigeration cycle has an excessive capability or is in a middle of removing cooling. Therefore, only an operation of reducing the throughput capacity of indoor heat exchanger BK [W/° C.] is admitted. In this case, for example, because it is evaluated that a distance to the target point is long by multiplying W1ijk calculated by Equation 6 in ST5 using ik satisfying ΔBKik=0 or ΔBKik<0, combinations of the manipulated variables (ΔFi, ΔBKij, ΔAKik) are finally selected among combinations of the manipulated variables satisfying ΔBK<0, namely reducing the throughput capacity of indoor heat exchanger.

By giving deviations to the above α3 and α4, for example, α3=3 and α4=2, in case that Tin is increasing, or α3=2 and α4=3 in case that Tin is decreasing, it is possible to stably bring a room temperature to a target value without hunting of the capability of refrigeration cycle.

In the above description, the case that only the suction air temperature is set or the case that both of the suction air temperature and the temperature difference of the discharge air minus the suction air are set but the temperature difference of the discharge air minus the suction air is not necessarily brought closer to the preset value is explained. However, the above description is also applicable to a case that only the discharge air temperature is set or a case that both of the discharge air temperature and the temperature difference of the discharge air temperature minus the suction air temperature are set and it is not important to bring the temperature difference of the suction air minus the discharge air closer to a preset value by substituting Tout for Tin.

Embodiment 5

In Embodiment 5, a method of bringing a suction air temperature and a discharge air temperature of an indoor closer to preset values at substantially the same time positively utilizing a fluid on a user side flowing through a heat exchanger on a user side, namely the suction air temperature minus the discharge air temperature of the indoor, will be described.

In addition to Equations 1 and 2, Equation 8 is now prepared to expressing how a temperature difference of the suction air minus the discharge air Tinout [° C.] is changed when actuators (F, AK, and BK) of a refrigeration cycle are respectively changed to a certain extent.

$$\Delta Pc=a\cdot\Delta F+c\cdot\Delta BK+e\cdot\Delta AK; \quad \text{(Equations 1)}$$

$$\Delta Pe=b\cdot\Delta F+d\cdot\Delta BK+f\cdot\Delta AK, \quad \text{(Equations 2)}$$

$$\Delta T\text{inout}=p\cdot\Delta F+q\cdot\Delta BK+r\cdot\Delta AK, \quad \text{(Equation 8)}$$

where

Pc: high pressure discharged from compressor 2 [Pa];

Pe: low pressure sucked by compressor 2 [Pa];

Tinout: temperature difference of suction air minus discharge air of indoor heat exchanger [° C.];

A: degree of change;

F: running frequency of compressor 2 [Hz];

BK: throughput capacity of indoor heat exchanger 6 [W/° C.]; and

AK: throughput capacity of outdoor heat exchanger 4 [W/° C.];

References a, b, c, d, e, f, p, q, and r respectively designates an quoitent predetermined by tests or calculations in conformity with characteristics of an air conditioner, wherein these are determined by the running frequency of the compressor, the throughput capacity of the outdoor heat exchanger, the throughput capacity of the indoor heat exchanger, an outdoor air temperature, an indoor air temperature, a high pressure value or a condensation temperature, a low pressure value or an evaporation temperature, and so on. In case of cooling, the quoitents b, e, f, and q are negative, and the quoitents a, c, d, p, and r are positive.

Preferable combinations (ΔFi, ΔBKij, ΔAKik; i=1–7, j=1–3, k=1–3), of the degree of change of the running frequency of the compressor ΔFi, the degree of change of the throughput capacity of the indoor heat exchanger ΔBKij, and the degree of change of the throughput capacity of the outdoor heat exchanger ΔAKik are determined in ST1 through ST3 shown in FIG. 5 described in Embodiment 1.

Then, it is presumed that how much extent running conditions in a high pressure and a low pressure of the refrigeration cycle and the temperature difference of the suction air minus the discharge air of the indoor reach by Equations 1, 2, and 8 using these preferable combinations, in a similar manner to Embodiment 1. This process corresponds to ST4 in FIG. 12. In the next, a process corresponding to ST5 in FIG. 12 will be described. The reachable conditions (Pcijk, Peijk, Tinoutijk; i=1–7, j=1–3, k=1–3) presumed above is judged whether or not Pcijk≧Pcm is satisfied to meet with an allowable range of high pressure target value and simultaneously whether or not Pem×

$0.95 \leqq Peijk \leqq Pem \times 1.05$ to meet with an allowable range of low pressure target value and simultaneously whether or not, for example, $Tinoutm-2 \leqq Tinoutijk \leqq Tinoutm+2$ (Tinoutm: target value of temperature difference of suction air minus discharge air) is satisfied to meet with an allowable range of the temperature difference of the suction air minus the discharge air. Then, the reachable conditions (Pcijk, Peijk, Tinoutijk) satisfying the allowable ranges of the high pressure value, the low pressure value, and the temperature difference of the suction air minus the discharge air are selected.

If there is no reachable condition (Pcijk, Peijk, Tinoutijk) satisfying the allowable ranges, a process is conducted instead of ST6. The process is to calculate an indication W4ijk representing a distance to the high pressure target value, the low pressure target value, and the target value of the temperature difference of the suction air minus the discharge air by Equation 9.

$$W4ijk=1-C\{A(Pcm-Pcijk)^2+B(Pem-Peijk)^2+D(Tinoutm-Tinoutijk)^2\} \quad \text{(Equation 9)}$$

Thereafter, a combination of manipulated variables (ΔFi, ΔBKij, ΔAKik) corresponding to combinations (Pcijk, Peijk, Tinoutijk) maximizing the indication W4ijk (i=1–7, j=1–3, k=1–3), representing the distance to the high pressure target value Pcm, the low pressure target value Pem, and the target value of the temperature difference of the suction air minus the discharge air Tinoutm, are selected.

As descried, by also using the temperature difference of the suction air minus the discharge air of the indoor air, it becomes possible to simultaneously bring the running condition of the refrigeration cycle and an air condition on a load side closer to proper values. Therefore, it becomes possible to run the refrigeration cycle to increase the number of revolutions of indoor blower by setting Tinoutm small for rapidly decreasing a temperature in case that the suction air temperature is high and to reduce the number of revolutions of indoor blower by setting Tinoutm large for dehumidifying without excessively reducing a temperature in case that the suction air temperature is close to a preset value. It becomes possible to prepare environments most comfortable for residents automatically and quickly by automatically changing the preset value of Tinoutm.

The first advantage of the apparatus for controlling refrigeration cycle according to the present invention is that a proper capability of the refrigeration cycle can be quickly demonstrated by synthetically controlling the running capacity of the compressor and the throughput capacities of the heat exchanger for evaporation and condensation; the consumption energy of the entire refrigeration cycle can be further reduced; and the capability of the refrigeration cycle can be properly demonstrated in response to conditions of a load.

The second advantage of the method of controlling the refrigeration cycle according to the present invention is that the degrees of change of the capacity of the compressor and the heat exchanging capabilities of the heat exchangers for condensation and evaporation can be properly selected in response to a changeable range; the capability of the refrigeration cycle can be properly demonstrated in response to the conditions of the load; and energy can be saved.

The third advantage of the method of controlling the refrigeration cycle according to the present invention is that the target on a low pressure side or the target on a high pressure side is quickly realized by changing a present running condition; and the capability of the refrigeration cycle is properly demonstrated; and energy consumption can be reduced.

Obviously, numerous modifications and variations of the present invention are possible in light of the above teachings. It is therefore to be understood that within the scope of the appended claims, the invention may be practiced otherwise than as specifically described herein.

What is claimed is:

1. An apparatus for controlling a refrigeration cycle for circulating a refrigerant through a compressor, a heat exchanger for condensation, a flow rate control valve, and a heat exchanger for evaporation, connected to each other, comprising:

first operation means for changing a heat exchanging capability of said heat exchanger for condensation, second operation means for changing a heat exchanging capability of said heat exchanger for evaporation, means for operating a running capacity for changing a running capacity of said compressor, and control means for reducing a difference between a running condition on either of a high pressure side and a low pressure side of said refrigeration cycle and a target.

2. The apparatus for controlling the refrigeration cycle according to claim 1, wherein said control means minimizes energy consumption of the refrigeration cycle when the difference between said running condition on the high pressure side or the low pressure side and said target is reduced.

3. The apparatus for controlling the refrigeration cycle according to claim 2, wherein said running condition on the high pressure side is one of a discharge pressure of said compressor and a saturation temperature corresponding to said discharge pressure; and said running condition on the low pressure side is one of a suction pressure of said compressor and a saturation temperature corresponding to said suction pressure.

4. The apparatus for controlling the refrigeration cycle according to claim 2, wherein said running condition on the high pressure side is one of a condensation pressure of said heat exchanger for condensation and a saturation temperature corresponding to said condensation pressure; and said running condition on the low pressure side is one of an evaporation pressure of said heat exchanger for evaporation and a saturation temperature corresponding to said evaporation pressure.

5. The apparatus for controlling the refrigeration cycle according to claim 1, wherein said running condition on the high pressure side is one of a discharge pressure of said compressor and a saturation temperature corresponding to said discharge pressure; and said running condition on the low pressure side is one of a suction pressure of said compressor and a saturation temperature corresponding to said suction pressure.

6. The apparatus for controlling the refrigeration cycle according to claim 1, wherein said running condition on the high pressure side is one of a condensation pressure of said heat exchanger for condensation and a saturation temperature corresponding to said condensation pressure; and said running condition on the low pressure side is one of an evaporation pressure of said heat exchanger for evaporation and a saturation temperature corresponding to said evaporation pressure.

7. An apparatus for controlling a refrigeration cycle for circulating a refrigerant through a compressor, a heat exchanger for condensation, a flow rate control valve, and a heat exchanger for evaporation, connected to each other, comprising:

first operation means for changing a heat exchanging capability of said heat exchanger for condensation, second operation means for changing a heat exchanging capability of said heat exchanger for evaporation, means for operating a running capacity for changing a running capacity of said compressor, and control means for reducing a difference between a running condition on a high pressure side or a low pressure side of said refrigeration cycle and a target, wherein said control means brings a temperature difference between an inlet temperature and an outlet temperature of a heat exchanging fluid in one of the heat exchangers for condensation and evaporation on a user side closer to a target temperature difference when the difference between said running condition on the high pressure side or the low pressure side and said target is reduced.

8. An apparatus for controlling a refrigeration cycle for circulating a refrigerant through a compressor, a heat exchanger for condensation, a flow rate control valve, and a heat exchanger for evaporation, connected to each other, comprising:

first operation means for changing a heat exchanging capability of said heat exchanger for condensation, second operation means for changing a heat exchanging capability of said heat exchanger for evaporation, means for operating a running capacity for changing a running capacity of said compressor, and control means for reducing a difference between a running condition on a high pressure side or a low pressure side of said refrigeration cycle and a target wherein said control means minimizes energy consumption of the refrigeration cycle when the difference between said running condition on the high pressure side or the low pressure side and said target is reduced, and wherein said control means brings a temperature difference between an inlet temperature and an outlet temperature of a heat exchanging fluid in one of the heat exchangers for condensation and evaporation on a user side closer to a target temperature difference when the difference between said running condition on the high pressure side or the low pressure side and said target is reduced.

9. An apparatus for controlling a refrigeration cycle for circulating a refrigerant through a compressor, a heat exchanger for condensation, a flow rate control valve, and a heat exchanger for evaporation, connected to each other, comprising:

first operation means for changing a heat exchanging capability of said heat exchanger for condensation, second operation means for changing a heat exchanging capability of said heat exchanger for evaporation, means for operating a running capacity for changing a running capacity of said compressor, control means for reducing a difference between a running condition on a high pressure side or a low pressure side of said refrigeration cycle and a target, target value setting means for automatically setting one of a target value representing one of said target of said running condition on the low pressure side and a target value representing said target of said running condition on the high pressure side with reference to a preset value of one of an inlet temperature and an outlet temperature of a heat exchanging fluid of one of said heat exchangers for condensation and evaporation on a user side; and wherein the other one of the target value representing said target of said running condition on the low pressure side and the target value representing said target of said running condition on the high pressure side is automatically set with reference to a temperature of a heat source.

10. The apparatus for controlling the refrigeration cycle according to claim 9, further comprising:

a target value changing means for increasing and decreasing said target value of said running condition on the low pressure side with reference to a relationship between said running condition on the low pressure side under a state of stabilized operation of the refrigeration cycle and said target value of said running condition on the low pressure side, wherein said heat exchanger for evaporation is used as said heat exchanger on the user side.

11. The apparatus for controlling the refrigeration cycle according to claim 10, wherein said target value changing means is adapted to increase and decrease said target value of said running condition on the low pressure side with reference to a relationship between said inlet temperature of the heat exchanging fluid in said heat exchanger on the user side under a state of stabilized operation and a target value of said inlet temperature and a relationship between said outlet temperature of the heat exchanging fluid in said heat exchanger on the user side and a target value of said outlet temperature.

12. The apparatus for controlling the refrigeration cycle according to claim 9, further comprising:

a target value changing means for increasing and decreasing said target value of said running condition on the high pressure side with reference to a relationship between said running condition on the high pressure side under a state of stabilized operation of the refrigeration cycle and said target value of said running condition on the high pressure side, wherein said heat exchanger for condensation is used as said heat exchanger on the user side.

13. The apparatus for controlling the refrigeration cycle according to claim 12, wherein said target value changing means is adapted to increase and decrease said target value of said running condition on the high pressure side with reference to a relationship between said inlet temperature of the heat exchanging fluid in said heat exchanger on the user side under a state of stabilized operation and a target value of said inlet temperature and a relationship between said outlet temperature of the heat exchanging fluid in said heat exchanger on the user side and a target value of said outlet temperature.

14. An apparatus for controlling a refrigeration cycle for circulating a refrigerant through a compressor, a heat exchanger for condensation, a flow rate control valve, and a heat exchanger for evaporation, connected to each other, comprising:

first operation means for changing a heat exchanging capability of said heat exchanger for condensation, second operation means for changing a heat exchanging capability of said heat exchanger for evaporation, means for operating a running capacity for changing a running capacity of said compressor, and control means for reducing a difference between a running condition on a high pressure side or a low pressure side of said refrigeration cycle and a target, target value setting means for automatically setting one of a target value representing one of said target of said running condition on the low pressure side and a target value representing said target of said running condition on the high pressure side with reference to a preset value of one of an inlet temperature and an outlet temperature of a heat exchanging fluid of one of said heat exchangers for condensation and evaporation on a user side; and wherein the other one of the target value representing said target of said running condition on the low pressure side and the target value representing said target of said running condition on the high pressure side is automatically set with reference to a temperature of a heat source, wherein said control means minimizes energy consumption of the refrigeration cycle when the difference between said running condition on the high pressure side or the low pressure side and said target is reduced.

15. The apparatus for controlling the refrigeration cycle according to claim 14, further comprising:

a target value changing means for increasing and decreasing said target value of said running condition on the low pressure side with reference to a relationship between said running condition on the low pressure side under a state of stabilized operation of the refrigeration cycle and said target value of said running condition on the low pressure side, wherein said heat exchanger for evaporation is used as said heat exchanger on the user side.

16. The apparatus for controlling the refrigeration cycle according to claim 14, further comprising:

a target value changing means for increasing and decreasing said target value of said running condition on the high pressure side with reference to a relationship between said running condition on the high pressure side under a state of stabilized operation of the refrigeration cycle and said target value of said running condition on the high pressure side, wherein said heat exchanger for condensation is used as said heat exchanger on the user side.

17. A method of controlling a refrigeration cycle comprising steps of:

making degrees of change of a plurality of capacities of a compressor to be parameters, said degrees of change are obtained from a change of running condition on a high pressure side or a low pressure side of the refrigeration cycle corresponding to a change of said plurality of capacities of the compressor, obtaining standard degrees of change of heat exchanging capabilities of a heat exchanger for condensation and a heat exchanger for evaporation to respectively bring said running conditions on the high pressure side and the low pressure side to their target values by respectively changing said heat exchanging capabilities of said heat exchangers for condensation and evaporation with respect to said degrees of change of said plurality of capacities of the compressor made as said parameters, respectively producing a plurality of degrees of change of said heat exchanging capabilities using said standard degrees of change of said heat exchanging capabilities of said heat exchangers for condensation and evaporation, operating said plurality of degrees of change so that these are respectively involved in ranges of said heat exchanging capabilities allowed for operating the refrigeration cycle when said plurality of degrees of change are not involved in said allowable ranges, and selecting degrees of change for bringing said running condition on the high pressure or low pressure side closer to its target value among said plurality of degrees of change of each of said heat exchanging capabilities obtained with respect to said plurality of capacities of the compressor as parameters.

18. The method of controlling the refrigeration cycle according to claim 17, further comprising:

a step of selecting combinations of said plurality of degrees of change minimizing a consumption energy of the refrigeration cycle by controlling said degrees of change of said running capacity of the compressor and said degrees of change of said heat exchanging capabilities of the heat exchanger for condensation and evaporation.

19. A method of controlling a refrigeration cycle comprising steps of:

operating each of standard degrees of change of a running capacity of a compressor, a heat exchanging capability of a heat exchanger for condensation, and a heat exchanging capability of a heat exchanger for evaporation for bringing a present running condition closer to a target value on a low pressure side or a high pressure side of the refrigeration cycle by changing said running capacity of the compressor and said heat exchanging capabilities of the heat exchangers for condensation and evaporation using a difference between said target on the low pressure side or the high pressure side and said present running condition, respectively producing a plurality of degrees of change from each of said standard degrees of change, repeating to produce said plurality of degrees of change so as to be respectively involved in ranges of said running capacity or said heat exchanging capabilities allowed for operating the refrigeration cycle when said plurality of degrees of change of said running condition of the compressor, the heat exchanger for evaporation, and the heat exchanger for condensation are not included in said ranges of said heat exchanging capabilities, and respectively selecting degrees of change for bringing said current running condition most closer to said target on the low or high pressure side among said reproduced plurality of degrees of change.

20. The method of controlling the refrigeration cycle according to claim 19, further comprising a step of selecting combinations of said plurality of degrees of change minimizing a consumption energy of the refrigeration cycle by controlling said degrees of change of said running capacity of the compressor and said degrees of change of said heat exchanging capabilities of the heat exchanger for condensation and evaporation.

21. An apparatus for controlling a refrigeration cycle for circulating a refrigerant through a compressor, a heat exchanger for condensation, a flow rate control valve, and a heat exchanger for evaporation, connected to each other, comprising:

first controller of heat exchanging capability of said heat exchanger for condensation, second controller of heat exchanging capability of said heat exchanger for evaporation, means for operating a running capacity for changing a running capacity of said compressor, and means for controlling any of said first controller, said second controller, and said means for operating and for reducing a difference between a running condition on either a high pressure side and a low pressure side of said refrigeration cycle and a target.

22. The apparatus for controlling the refrigeration cycle according to claim 21, wherein said control means minimizes energy consumption of the refrigeration cycle when the difference between said running condition on the high pressure side or the low pressure side and said target is reduced.

23. An apparatus for controlling a refrigeration cycle for circulating a refrigerant through a compressor, a heat exchanger for condensation, a flow rate control valve, and a heat exchanger for evaporation, connected to each other, comprising:

first controller of heat exchanging capability of said heat exchanger for condensation, second controller of heat exchanging capability of said heat exchanger for evaporation, means for operating a running capacity for changing a running capacity of said compressor, and means for controlling any of said first controller, said second controller, and said means for operating and for reducing a difference between a running condition on either a high pressure side and a low pressure side of said refrigeration cycle and a target, wherein said control means brings a temperature difference between an inlet temperature and an outlet temperature of a heat exchanging fluid in one of the heat exchangers for condensation and evaporation on a user side closer to a target temperature difference when the difference between said running condition on the high pressure side or the low pressure side of said target is reduced.

24. An apparatus for controlling a refrigeration cycle for circulating a refrigerant through a compressor, a heat exchanger for condensation, a flow rate control valve, and a heat exchanger for evaporation, connected to each other, comprising:

first controller of heat exchanging capability of said heat exchanger for condensation, second controller of heat exchanging capability of said heat exchanger for evaporation, means for operating a running capacity for changing a running capacity of said compressor, and means for controlling any of said first controller, said second controller, and said means for operating and for reducing a difference between a running condition on either a high pressure side and a low pressure side of said refrigeration cycle and a target, wherein said control means minimizes energy consumption of the refrigeration cycle when the difference between said running condition on the high pressure side or the low pressure side and said target is reduced, and wherein said control means brings a temperature difference between an inlet temperature and an outlet temperature of a heat exchanging fluid in one of the heat exchangers for condensation and evaporation on a user side closer to a target temperature difference when the difference between said running condition on the high pressure side or the low pressure side of said target is reduced.

25. An apparatus for controlling a refrigeration cycle for circulating a refrigerant through a compressor, a heat exchanger for condensation, a flow rate control valve, and a heat exchanger for evaporation, connected to each other, comprising:

first controller of heat exchanging capability of said heat exchanger for condensation, second controller of heat exchanging capability of said heat exchanger for evaporation, means for operating a running capacity for changing a running capacity of said compressor, means for controlling any of said first controller, said second controller, and said means for operating and for reducing a difference between a running condition on either a high pressure side and a low pressure side of said refrigeration cycle and a target, and target value setting means for automatically setting one of a target value representing one of said target of said running condition on the low pressure side and a target value representing said target of said running condition on the high pressure side with reference to a preset value of one of an inlet temperature and an outlet temperature of a heat exchanging fluid of one of said heat exchangers for condensation and evaporation on a user side; and wherein the other one of the target value representing said target of said running condition on the low pressure side and the target value representing said target of said running condition on the high pressure side is automatically set with reference to a temperature of a heat source.

26. The apparatus for controlling the refrigeration cycle according to claim 25, further comprising:

a target value changing means for increasing and decreasing said target value of said running condition on the low pressure side with reference to a relationship between said running condition on the low pressure side under a state of stabilized operation of the refrigeration cycle and said target value of said running condition on the low pressure side, wherein, said heat exchanger for evaporation is used as said heat exchanger on the user side.

27. The apparatus for controlling the refrigeration cycle according to claim 26, wherein said target value changing means is adapted to increase and decrease said target value of said running condition on the low pressure side with reference to a relationship between said inlet temperature of the heat exchanging fluid in said heat exchanger on the user side under a state of stabilized operation and a target value of said inlet temperature and a relationship between said outlet temperature of the heat exchanging fluid in said heat exchanger on the user side and a target value of said outlet temperature.

28. The apparatus for controlling the refrigeration cycle according to claim 25, further comprising:

a target value changing means for increasing and decreasing said target value of said running condition on the high pressure side with reference to a relationship between said running condition on the high pressure side under a state of stabilized operation of the refrigeration cycle and said target value of said running condition on the high pressure side, wherein said heat exchanger for condensation is used as said heat exchanger on the user side.

29. The apparatus for controlling the refrigeration cycle according to claim 28, wherein said target value changing means is adapted to increase and decrease said target value of said running condition on the high pressure side with reference to a relationship between said inlet temperature of the heat exchanging fluid in said heat exchanger on the user side under a state of stabilized operation and a target value of said inlet temperature and a relationship between said outlet temperature of the heat exchanging fluid in said heat exchanger on the user side and a target value of said outlet temperature.

30. An apparatus for controlling a refrigeration cycle for circulating a refrigerant through a compressor, a heat exchanger for condensation, a flow rate control valve, and a heat exchanger for evaporation, connected to each other, comprising:

first controller of heat exchanging capability of said heat exchanger for condensation, second controller of heat exchanging capability of said heat exchanger for evaporation, means for operating a running capacity for changing a running capacity of said compressor, and means for controlling any of said first controller, said second controller, and said means for operating and for reducing a difference between a running condition on either a high pressure side and a low pressure side of said refrigeration cycle and a target, and target value setting means for automatically setting one of a target value representing one of said target of said running condition on the low pressure side and a target value representing said target of said running condition on the high pressure side with reference to a preset value of one of an inlet temperature and an outlet temperature of a heat exchanging fluid of one of said heat exchangers for condensation and evaporation on a user side; and wherein said control means minimizes energy consumption of the refrigeration cycle when the difference between said running condition on the high pressure side or the low pressure side and said target is reduced, and the other one of the target value representing said target of said running condition on the low pressure side and the target value representing said target of said running condition on the high pressure side is automatically set with reference to a temperature of a heat source.

31. The apparatus for controlling the refrigeration cycle according to claim 30, further comprising:

a target value changing means for increasing and decreasing said target value of said running condition on the low pressure side with reference to a relationship between said running condition on the low pressure side under a state of stabilized operation of the refrigeration cycle and said target value of said running condition on the low pressure side, wherein said heat exchanger for evaporation is used as said heat exchanger on the user side.

32. The apparatus for controlling the refrigeration cycle according to claim 30, further comprising:

a target value changing means for increasing and decreasing said target value of said running condition on the high pressure side with reference to a relationship between said running condition on the high pressure side under a state of stabilized operation of the refrigeration cycle and said target value of said running condition on the high pressure side, wherein said heat exchanger for condensation is used as said heat exchanger on the user side.

* * * * *